US007601097B2

(12) United States Patent
Miyamaru et al.

(10) Patent No.: US 7,601,097 B2
(45) Date of Patent: Oct. 13, 2009

(54) BICYCLE SIMULATION APPARATUS

(75) Inventors: Yukio Miyamaru, Saitama (JP); Atsushi Yonehana, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 886 days.

(21) Appl. No.: 11/095,455

(22) Filed: Apr. 1, 2005

(65) Prior Publication Data

US 2005/0221960 A1 Oct. 6, 2005

(30) Foreign Application Priority Data

Apr. 1, 2004 (JP) ..... 2004-108906

(51) Int. Cl.
*A63B 21/005* (2006.01)

(52) U.S. Cl. ..... 482/5; 434/61

(58) Field of Classification Search ..... 482/5; 434/61

See application file for complete search history.

(56) References Cited

U.S. PATENT DOCUMENTS 4,786,049 A 11/1988 Keiper
5,226,501 A * 7/1993 Takata ..... 180/206
5,240,417 A * 8/1993 Smithson et al. ..... 434/61
6,034,594 A * 3/2000 Gray ..... 340/440
6,336,891 B1 * 1/2002 Fedrigon et al. ..... 482/8
2002/0068499 A1 * 6/2002 Huntsberger et al. ..... 446/93
2004/0036327 A1 * 2/2004 Barandiaran Salaberria ..... 297/215.13

FOREIGN PATENT DOCUMENTS

DE 37 06 250 A1 9/1988
EP 1 327 465 A1 7/2003
JP 2589581 A 11/1998

* cited by examiner

*Primary Examiner*—Loan H Thanh
*Assistant Examiner*—Shila Abyaneh
(74) *Attorney, Agent, or Firm*—Birch, Stewart, Kolasch & Birch, LLP

(57) ABSTRACT

To simulatively implement a retreating movement of a bicycle in a state wherein a rider dismounts from the bicycle. A simulated bicycle includes a steering angle sensor for detecting a steering angle of a handlebar, a momentary type retreating switch provided at a rear lower portion of a saddle, and a monitor for displaying a scene based on a simulated traveling speed, the steering angle and a signal of the retreating switch. When the retreating switch is operated, an image of a bicycle and a person who operates the bicycle to retreat is displayed on the monitor. The retreating switch is operated through a level so that the rider having dismounted from the bicycle can readily manually operate the same.

18 Claims, 29 Drawing Sheets

206 202 208

| COMMAND | PROCESS |
|---|---|
| UPPER<br>LOWER<br>MAKE HEAVIER<br>MAKE LIGHTER<br>⋮ | BIRD'S EYE VIEW DISPLAY<br>RIDER'S EYE VIEW DISPLAY<br>INCREASE OF THE LOAD AND INCREASE OF THE VELOCITY COEFFICIENT<br>DECREASE OF THE LOAD AND DECREASE OF THE VELOCITY COEFFICIENT<br>⋮ |
| BIRD'S EYE VIEW<br>RIDER'S EYE VIEW<br>SHIFT-UP<br>SHIFT-DOWN<br>⋮ | BIRD'S EYE VIEW DISPLAY<br>RIDER'S EYE VIEW DISPLAY<br>INCREASE OF THE LOAD AND INCREASE OF THE VELOCITY COEFFICIENT<br>DECREASE OF THE LOAD AND DECREASE OF THE VELOCITY COEFFICIENT<br>⋮ |
| LEFT<br>RIGHT<br>⋮ | LEFTWARD SCREEN DISPLAY<br>RIGHTWARD SCREEN DISPLAY<br>⋮ |

206a 206b 206c 202a 202b 202c

FIG.12

BICYCLE SIMULATION APPARATUS

CROSS-REFERENCE TO RELATED APPLICATIONS

The present application claims priority under 35 USC 119 to Japanese Patent Application No. 2004-108906 filed on Apr. 1, 2004 the entire contents of which are hereby incorporated by reference.

BACKGROUND OF THE INVENTION

1. Field of the Invention

This invention relates to a bicycle simulation apparatus used for such applications as traffic safety education, games, training and so forth.

2. Description of Background Art

For simulated experience of operation of an airplane, an automobile, a motorcycle, a bicycle and so forth, various simulation apparatus individually corresponding to such vehicles have been proposed and partly placed into practical use. Of those simulation apparatus, the bicycle simulation apparatus is configured such that, while a rider is seated on a saddle of a simulated bicycle, the rider operates pedals and operates a handlebar to perform simulated operation. See, for example, Japanese Utility Model Publication No. 2589581. In short, a conventional bicycle simulation apparatus is configured in a situation that supposes only that the bicycle moves forwardly.

In a conventional bicycle simulation apparatus, when the bicycle comes excessively near to a simulated obstacle forwardly thereof during a simulated operation, the bicycle cannot move, and it is necessary to end the simulated operation or perform an unnatural process which does not really occur such as to erase the simulated obstacle.

Further, for example, when the bicycle tries to turn to the right (to the left in a country in which an automobile keeps to the right) at two stages at a crossing or the like, it is necessary for the rider to perform a movement of getting off the bicycle once and then changing the direction of movement while retreating. However, with the conventional bicycle simulation apparatus, such a retreating operation cannot be simulatively implemented. Further improvement is demanded in applications for traffic safety education.

SUMMARY AND OBJECTS OF THE INVENTION

The present invention has been made by taking into consideration the description as described. It is an object of the present invention to provide a bicycle simulation apparatus which simulatively implements a retreating movement of a bicycle in a state wherein a rider gets off the bicycle and makes it possible to perform simulated operation which provides much more of a feeling of presence.

According to the present invention, a bicycle simulation apparatus includes a simulated bicycle including a saddle for a rider and a steering section for being operated by the rider. A momentary type retreating switch is provided on the simulated bicycle and is manually operable by the rider who has dismounted from the simulated bicycle. A display section is provided for displaying a scene based on the operation of the steering section and a signal of the retreating switch. When the retreating switch is operated, an image of a bicycle and a person who operates the bicycle to retreat is displayed on the display section.

Where an image of a bicycle and a person who operates the bicycle to retreat is displayed in response to an operation of the retreating switch in this manner, a retreating movement of the bicycle can be simulatively implemented and the rider can perform a simulated operation which is more realistic and provides much more of a feeling of presence.

The bicycle simulation apparatus may be configured such that the bicycle simulation apparatus further includes a rider detection section for detecting that the rider lands a foot thereof on the floor. The image that is displayed on the display section takes this as an additional condition and the rider detection section detects it at predetermined intervals that the foot of the rider is landed on the floor.

By detecting it at predetermined intervals by means of the rider detection section that the foot of the rider has landed on the floor, walking can be simulatively implemented. Thus, a more realistic retreating movement can be simulatively implemented by cooperative action with the rider detection section and an operation of the retreating switch.

Further, the retreating switch may be provided at a rear portion or a rear lower portion of the saddle. When the rider gets off the bicycle and tries to operate the bicycle to retreat, generally the rider grips an end portion of the handlebar with one hand thereof and grips the saddle with the other hand thereof to operate the bicycle to retreat. Therefore, by providing the retreating switch at a rear portion or a rear lower portion of the saddle, an ordinary posture in operating the bicycle to retreat is obtained, and a more realistic retreating movement can be simulatively implemented. Further, where the retreating switch is provided at this position, in ordinary simulated traveling in which the rider is seated on the saddle, the rider cannot readily touch the retreating switch, and there is no possibility that the retreating switch is operated in error. Furthermore, the retreating switch does not make an obstacle to the rider when the rider is seated on the saddle.

Where the bicycle simulation apparatus is configured such that the retreating switch is operated through a predetermined lever, the rider having dismounted from the bicycle can readily operate the retreating switch. Further, an operational portion of the lever can be disposed at a place at which a hand of the driver can readily reach, and the degree of freedom in selection in design of the size, shape and number of such retreating switches is high.

With the bicycle simulation apparatus according to the present invention, since an image of a bicycle and a person who operates the bicycle to retreat is displayed in response to an operation of the retreating switch, a retreating movement of the bicycle in a state wherein the rider gets off the bicycle can be simulatively implemented and the rider can perform a simulated operation which is more realistic and provides much more of a feeling of presence.

By detecting it at predetermined intervals by means of the rider detection section that the foot of the rider has landed on the floor, walking can be simulatively implemented, and a more realistic retreating movement can be simulatively implemented by cooperative action with the rider detection section and an operation of the retreating switch.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 12 is a diagrammatic view illustrating contents of in-city traveling dictionary data;

DETAILED DESCRIPTION OF THE PREFERRED EMBODIMENTS

In the following, an embodiment of a bicycle simulation apparatus according to the present invention is described with reference to FIGS. 1 to 29 of the accompanying drawings.

Figure 1:
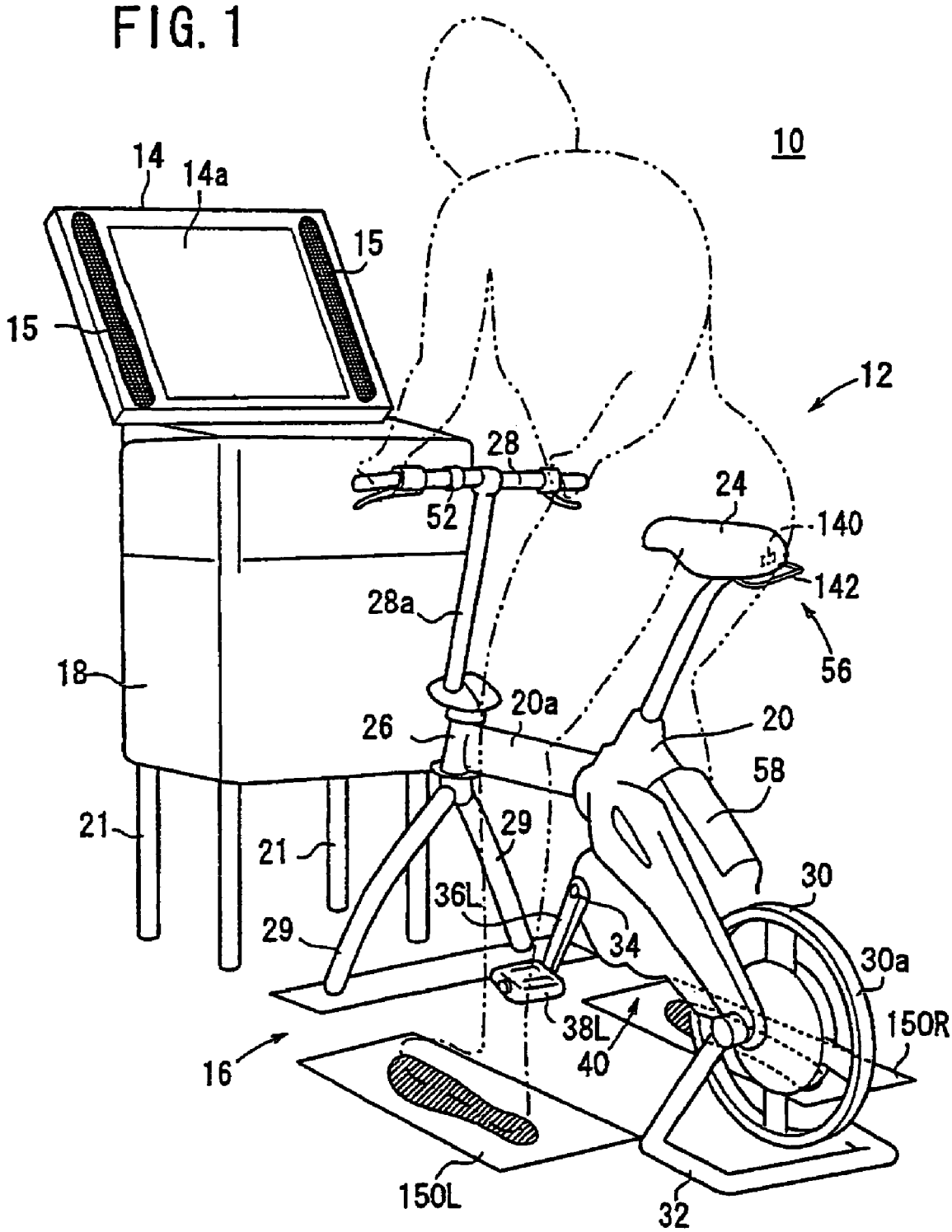
FIG. 1 is a perspective view of a simulation apparatus according to an embodiment.

As shown in FIG. 1, the bicycle simulation apparatus 10 according to the present embodiment is a bicycle simulation apparatus of a bicycle and includes a simulated bicycle (simulated vehicle) 12, and a monitor (outputting section) 14 for displaying a scene in accordance with the riding of the simulated bicycle 12 on a screen 14*a*. The bicycle simulation apparatus 10 further includes a speaker 15 for issuing a speech instruction to the rider and for generating simulated sound. A mat switch 16 is provided at a position at which the drivers gets on and off the simulated bicycle. A main control section 18 is provided for generally controlling the bicycle simulation apparatus 10. The main control section 18 is disposed forwardly of the simulated bicycle 12, and the monitor 14 and the speaker 15 are disposed at positions above the main control section 18 at which they can be easily observed by the rider on the simulated bicycle 12.

Figure 10:
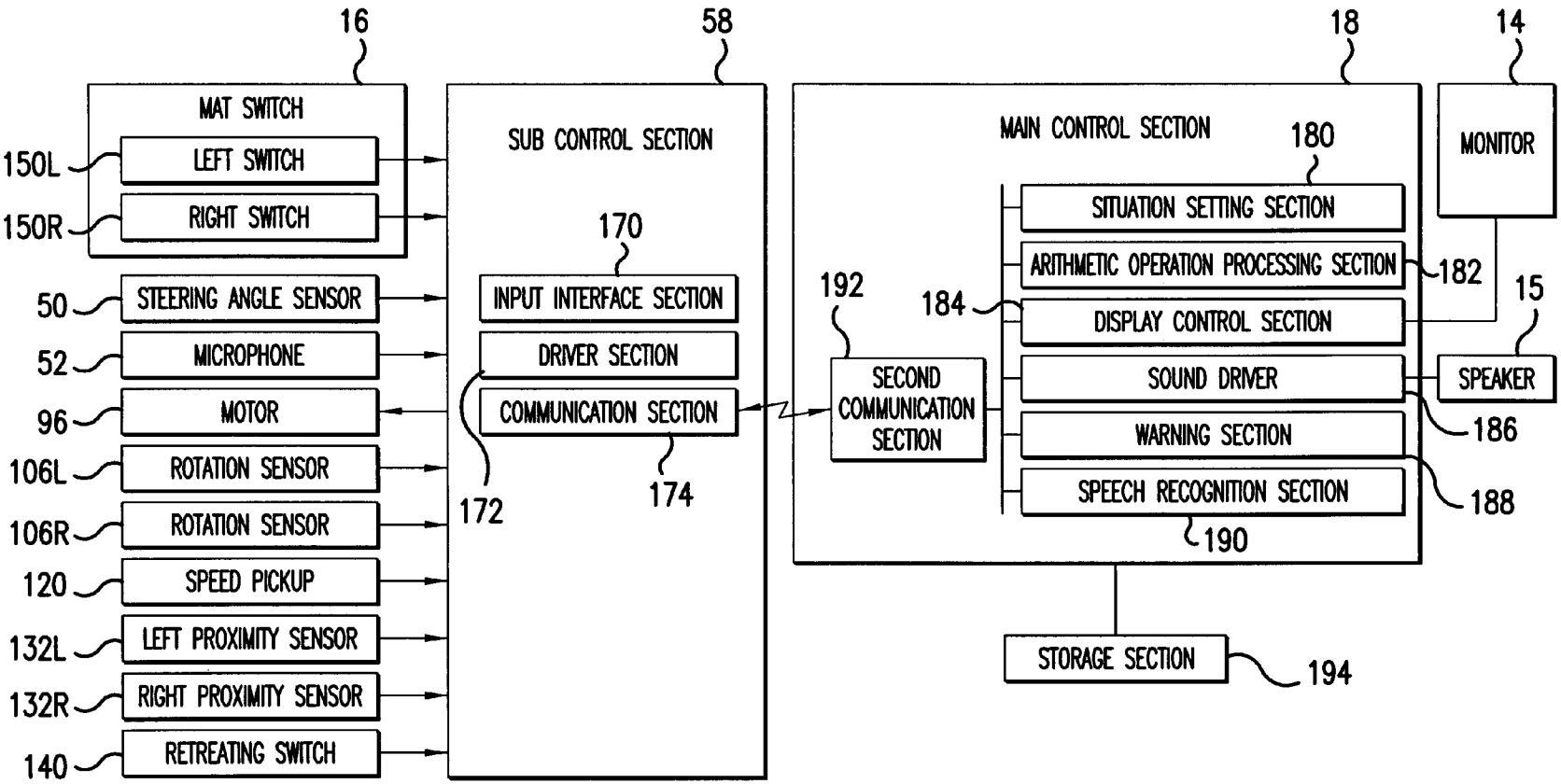
FIG. 10 is a block diagram of an electric configuration of the simulation apparatus.

The screen 14*a* of the monitor 14 displays a speech recognition mark 19 (refer to FIG. 14) as an indicator for indicating that the speech recognition process is valid under the action of the speech recognition section 190 (refer to FIG. 10). The speech recognition mark 19 is formed from a mark representative of the shape of a microphone and a character string of "microphone on." The main control section 18, monitor 14 and speaker 15 are supported for upward and downward movement by four support posts 21 so that the positions thereof can be adjusted in accordance with the physique of the rider. The monitor 14 may be a monitor of a small size which is provided, for example, at an upper portion of a handlebar 28.

The simulated bicycle 12 is hereinafter described. In the following description, mechanisms which are provided one by one on the left and right of the simulated bicycle 12 are denoted distinctly such that "L" is added to a reference number for left mechanisms while "R" is added to the reference number for right mechanisms.

The simulated bicycle 12 includes a frame 20, a saddle (seat) 24 connected to the frame 20 through a seat pillar, a handlebar 28 mounted for pivotal motion on a head tube 26 of the frame 20, and two front forks 29 serving as stands for fixedly supporting the head tube 26 thereon. The simulated bicycle 12 further includes a flywheel 30 made of iron and provided at a rear end portion of the frame 20, and a back stand 32 for supporting the frame 20 such that the flywheel 30 is spaced away from the floor. The saddle 24 and the handlebar 28 can be adjusted in a vertical position in conformity with the physique of the rider.

Figure 2:
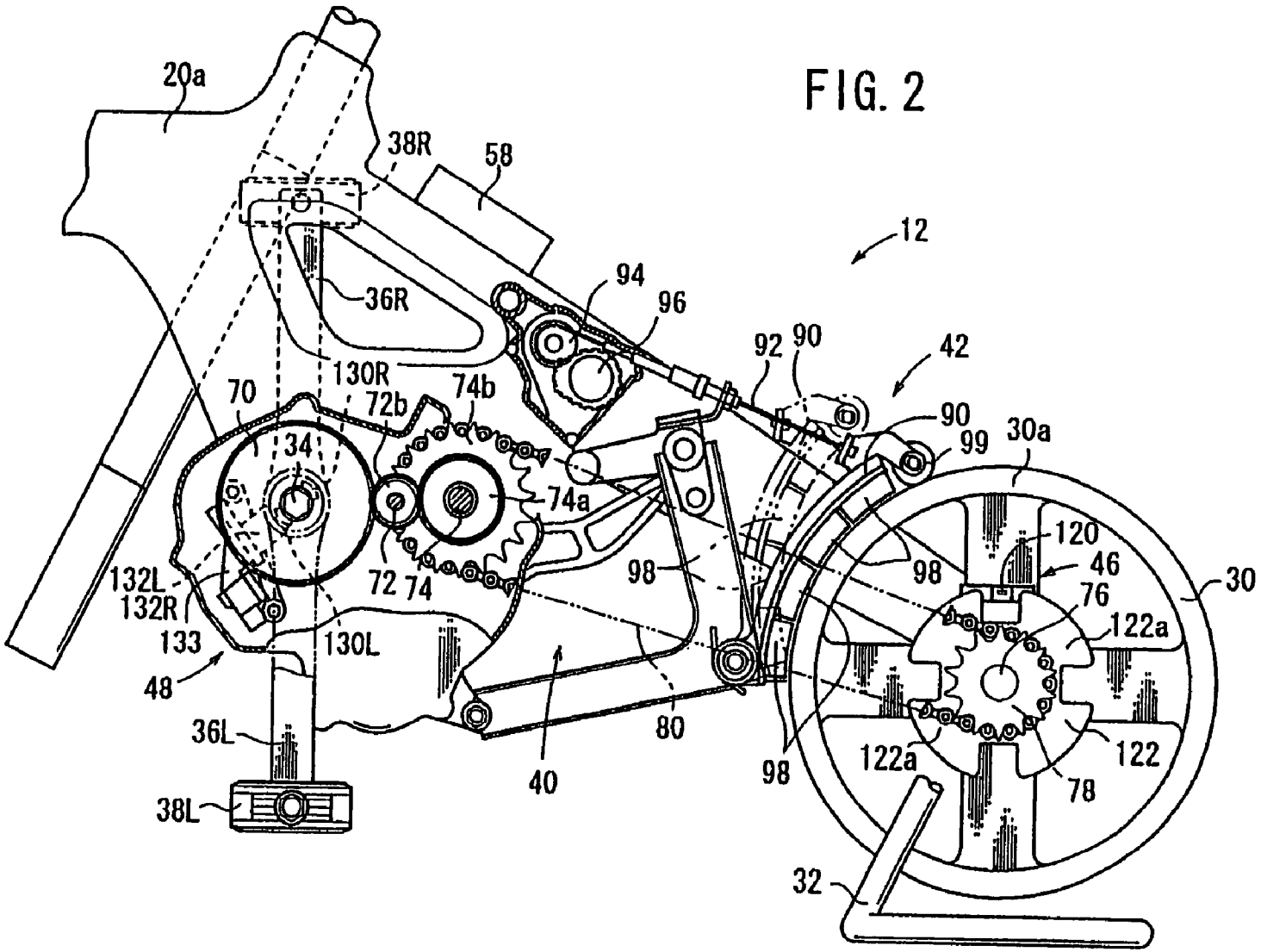
FIG. 2 is an enlarged side elevational view, partly in section, of a simulated bicycle.
Figure 4:
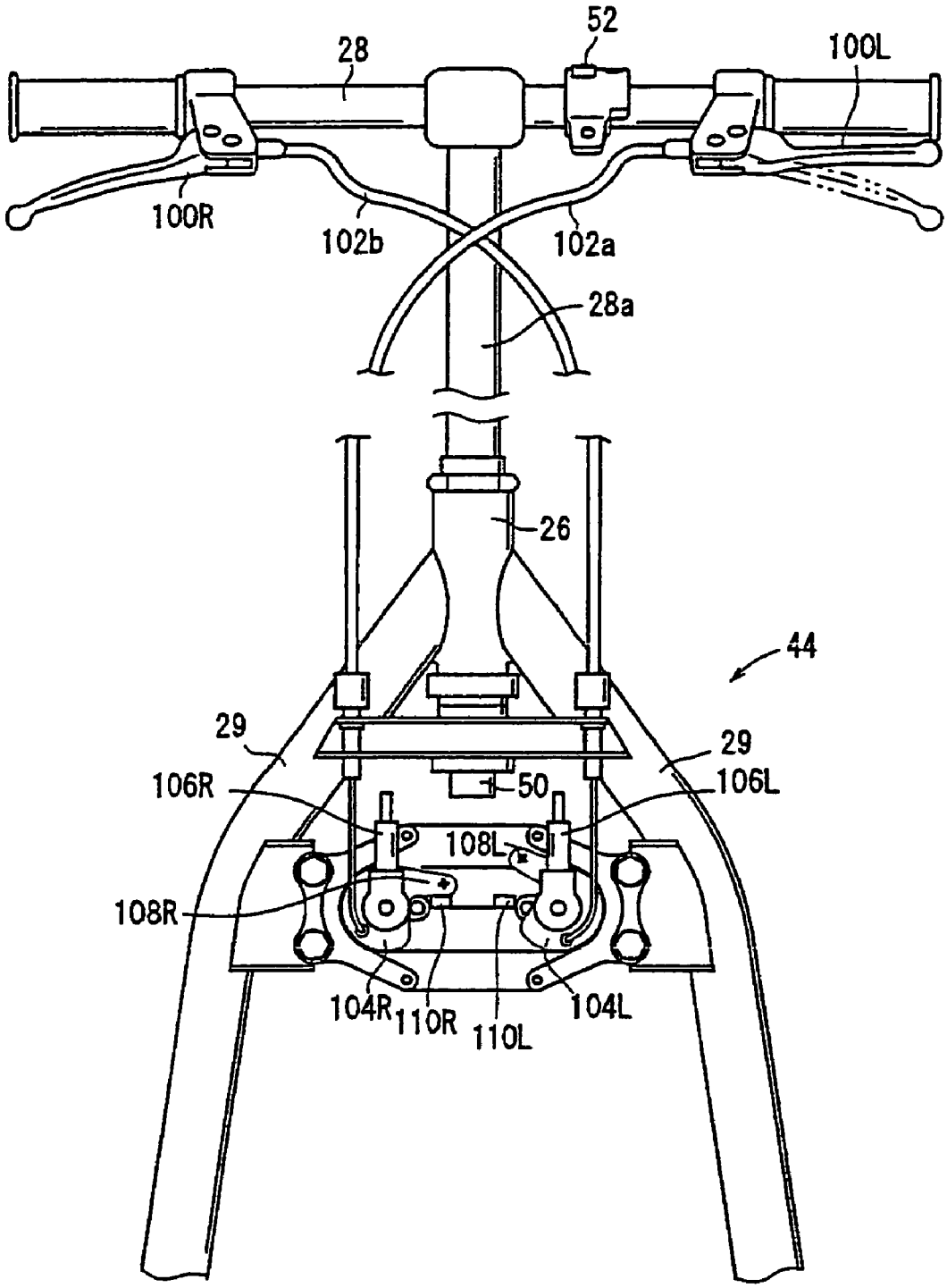
FIG. 4 is a front elevational view of the simulated bicycle.

As shown in FIGS. 1, 2 and 4, the simulated bicycle 12 includes a pair of cranks 36L and 36R connected to the left and right of a crankshaft 34, pedals 38L and 38R provided at ends of the cranks 36L and 36R, and a driving force transmission section 40 for transmitting rotation of the crankshaft 34 to the flywheel 30.

Further, the simulated bicycle 12 includes, as electric mechanisms, a load section 42 for applying load to the flywheel 30, a braking instruction section 44 for braking the flywheel 30, and a speed detection section 46 for detecting the speed of rotation of the flywheel 30. The simulated bicycle 12 further includes, a crank position detection section 48 for detecting the rotational positions of the cranks 36L and 36R, a steering angle sensor 50 (refer to FIG. 4) for detecting a steering angle $\theta_H$ of the handlebar 28, a microphone 52 for inputting the voice of the rider, and a grip detection section 56 provided at a rear lower portion of the saddle 24. Further, a sub-control section 58 for receiving signals from the electric mechanism mentioned above and performing predetermined control is provided for the simulated bicycle 12, and the sub-control section 58 and the main control section 18 can perform real-time mutual communication therebetween.

Figure 3:
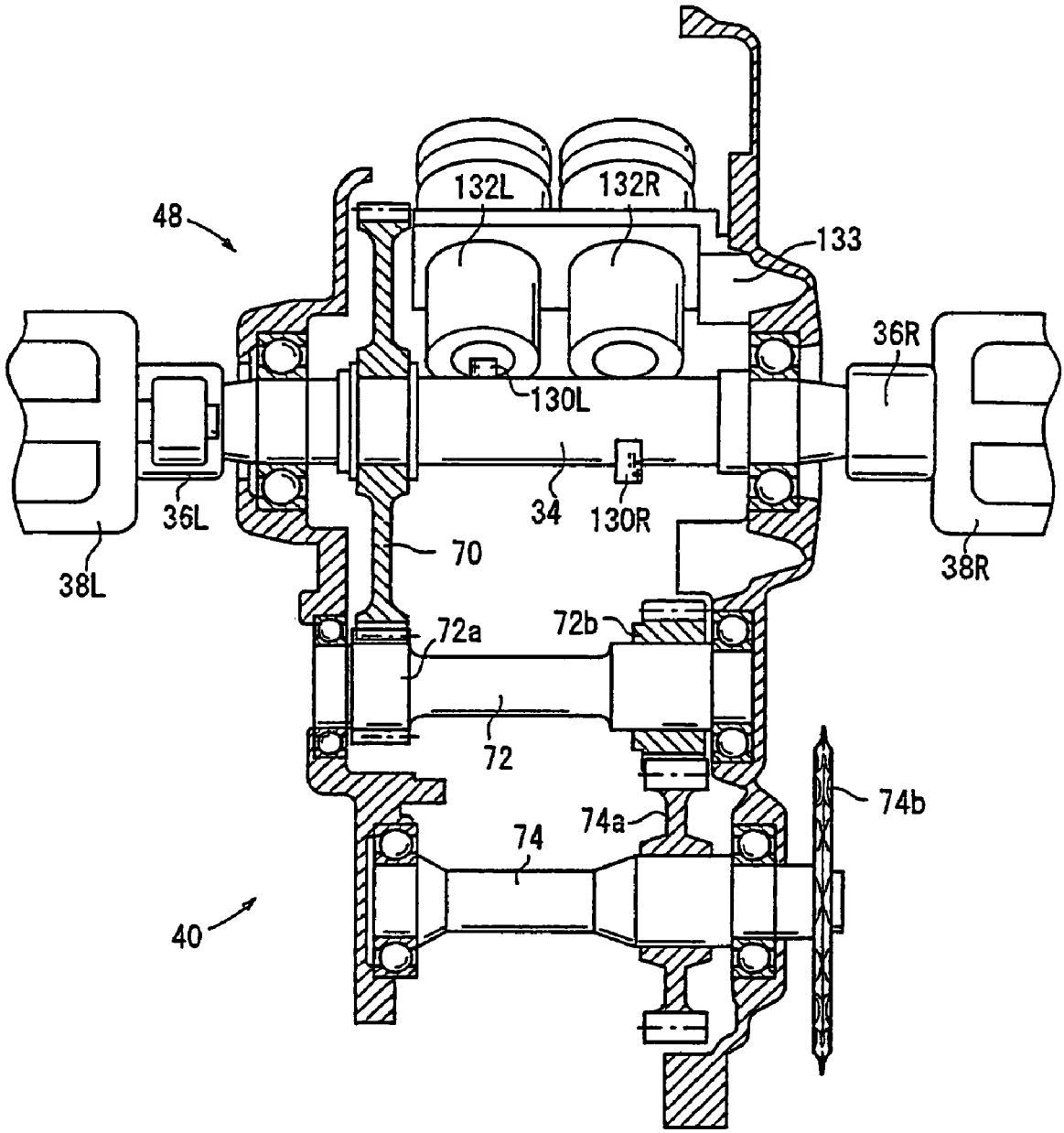
FIG. 3 is a plan view, partly in section, of a driving force transmission section.

As shown in FIGS. 2 and 3, the driving force transmission section 40 includes a driving gear 70 provided on the crankshaft 34, a first intermediate shaft 72 having a driven gear 72*a* and a driving gear 72*b* and a second intermediate shaft 74 having a driven gear 74*a* and a driving sprocket wheel 74*b*. The driving gear 70 is held in meshing engagement with the driven gear 72*a* while the driving gear 72*b* is held in meshing engagement with the driven gear 74*a*. Consequently, the second intermediate shaft 74 receives and is rotated by a driving force of the crankshaft 34 through the first intermediate shaft 72.

The driving force transmission section 40 further includes a free hub 76 for supporting the flywheel 30, a driven sprocket wheel 78 provided on the free hub 76, and a chain 80 for transmitting a driving force of the driving sprocket wheel 74*b* to the driven sprocket wheel 78. The crankshaft 34, first intermediate shaft 72 and second intermediate shaft 74 are each supported for rotation by two bearings. The free hub 76 has a bearing built therein.

The free hub 76 transmits only rotational driving force in the forward direction of the driven sprocket wheel 78 to the flywheel 30 by means of a one-way clutch mechanism provided therein. Accordingly, when the crankshaft 34 rotates in the opposite direction, or when rotation of the crankshaft 34 stops while the flywheel 30 is rotating in the forward direction, the flywheel 30 maintains its rotational state (rotation in the positive direction or stopping) at the point in time irrespective of the crankshaft 34.

The load section 42 includes an arcuate load plate 90 supported at an end thereof for pivotal motion on the frame 20 with a pull cable 92 connected to the other end of the load plate 90. A drum 94 is provided for taking up the pull cable 92. A motor (outputting section) 96 is provided for driving the drum 94 to rotate. The load plate 90 has a plurality of ferrite magnets 98 adhered thereto that are concentrically arranged with the flywheel 30 in an opposing relationship to a rim 30*a* on the outer periphery of the flywheel 30. The load plate 90 is biased to tilt toward the flywheel 30 by a torsion spring, and when it is not pulled by the pull cable 92, a roller 99 provided at the other end of the load plate 90 contacts with and is rotated by the rim 30*a*. At this time, the ferrite magnets 98 and the rim 30*a* come very close to each other, and when the flywheel 30 rotates, eddy current flows in the rim 30*a* to generate eddy-current loss, whereby a load can be applied to the flywheel 30. Since load is applied by eddy current, a quiet operation with minimum mechanical noise can be achieved.

Further, when the pull cable 92 is taken up under the action of the motor 96, the load plate 90 is tilted to space the ferrite magnets 98 away from the rim 30*a*. Accordingly, the load to the flywheel 30 can be adjusted under the action of the motor 96, and when the load plate 90 is displaced the farthest away from the rim 30*a*, the load is substantially equal to zero. The load to the flywheel 30 by the load section 42 acts also as a braking force, and the load section 42 serves also as a braking means. Since the load section 42 does not include a sliding portion for braking, the exchange of parts such as a brake pad which are required by a type wherein the load is generated by a mechanical braking is unnecessary.

Further, when the estimated transmission gear ratio is high and the pedals 38L and 38R are being pedaled, it is possible to cause the rider to feel a heavy operation of the pedals 38L and 38R by moving the load plate 90 toward the rim 30*a*, and a simulated gear change can be performed. In this instance, when the pedals 38L and 38R are not being pedaled, the load plate 90 should be spaced away from the rim 30*a* so that an unnatural braking may not be performed. Whether or not the pedals 38L and 38R are being pedaled can be decided based on signals obtained from a left proximity sensor 132L and a right proximity sensor 132R.

As shown in FIG. 4, the braking instruction section 44 includes two brake levers 100L and 100R provided on the handlebar 28 with brake wires 102*a* and 102*b* extending from the handlebar 28 to the front forks 29. Resiliently rotatable pulleys 104L and 104R are provided together with rotation sensors 106L and 106R. The brake wire 102*a* and the brake wire 102*b* intermediately cross each other and are connected at the opposite ends thereof to the brake levers 100L and 100R and the pulleys 104R and 104L, respectively.

The pulleys 104L and 104R are resiliently biased by springs (not shown) such that, when the brake levers 100L and 100R are not pulled, projections 108L and 108R thereof are directed upwardly. At this time, the brake levers 100L and 100R are resiliently biased by the pulleys 104L and 104R and spaced away from the handlebar 28.

If the brake levers 100L and 100R are pulled towards the handlebar 28, then the pulleys 104L and 104R are rotated resiliently until the projections 108L and 108R are directed downwardly. The pulleys 104L and 104R can rotate until the projections 108L and 108R are contacted with stops 110L and 110R, respectively.

The angles of rotation of the pulleys 104L and 104R can be detected by the rotation sensors 106L and 106R, respectively, and the detected angle signals are supplied to the sub-control section 58. The sub-control section 58 controls the load section 42 based on the detected rotational angle signals of the pulleys 104L and 104R, that is, signals corresponding to the amounts of operation (hereinafter referred to as a braking operation) of the brake levers 100L and 100R, to apply a braking force to the flywheel 30. For example, the load plate 90 is moved towards the flywheel 30 in proportion to a sum value of the rotational angle of the pulley 104L and the rotational angle of pulley 104R to increase the load such that, when the sum value indicates a maximum value, the load plate 90 is positioned nearest to the flywheel 30. When no braking operation is performed, the load plate 90 is spaced most away from the flywheel 30 to reduce the load to substantially zero.

In the braking instruction section 44, since a braking operation is converted into electric signals by the rotation sensors 106L and 106R, the operational amount of the braking operation can be recognized by the sub-control section 58. Thus, the braking instruction section 44 can perform elaborate processing or adjustment corresponding to the operational amount, and the load section 42 which is driven electrically can be used also as a brake.

Further, as shown in FIG. 4, the steering angle sensor 50 is provided at a lower end portion of the head tube 26 and detects a pivotal angle of a stem 28*a* which supports the handlebar 28 thereon. The microphone 52 is provided on the handlebar 28, and since the microphone 52 is positioned nearly to the face of the rider, the voice of the rider is inputted clearly to the microphone 52. The steering angle sensor 50 and the microphone 52 are connected to the sub-control section 58 and supply an angle signal of a steering angle $\theta_B$ and a speech signal.

Referring back to FIG. 2, the speed detection section 46 includes a speed pickup 120 provided on the frame 20 through a bracket, and a pickup rotor 122 mounted coaxially for integral rotation on the flywheel 30. The pickup rotor 122 has four radial blades 122*a*, and the speed pickup 120 detects each of the blades 122*a* passing in front thereof to detect the speed of rotation of the flywheel 30. The flywheel 30 can be regarded as a wheel of an actual bicycle, and by detecting the speed of rotation of the flywheel 30, a simulated riding traveling speed of the simulated bicycle 12 can be detected. A detection signal of the speed pickup 120 is supplied to the sub-control section 58.

Figure 5:
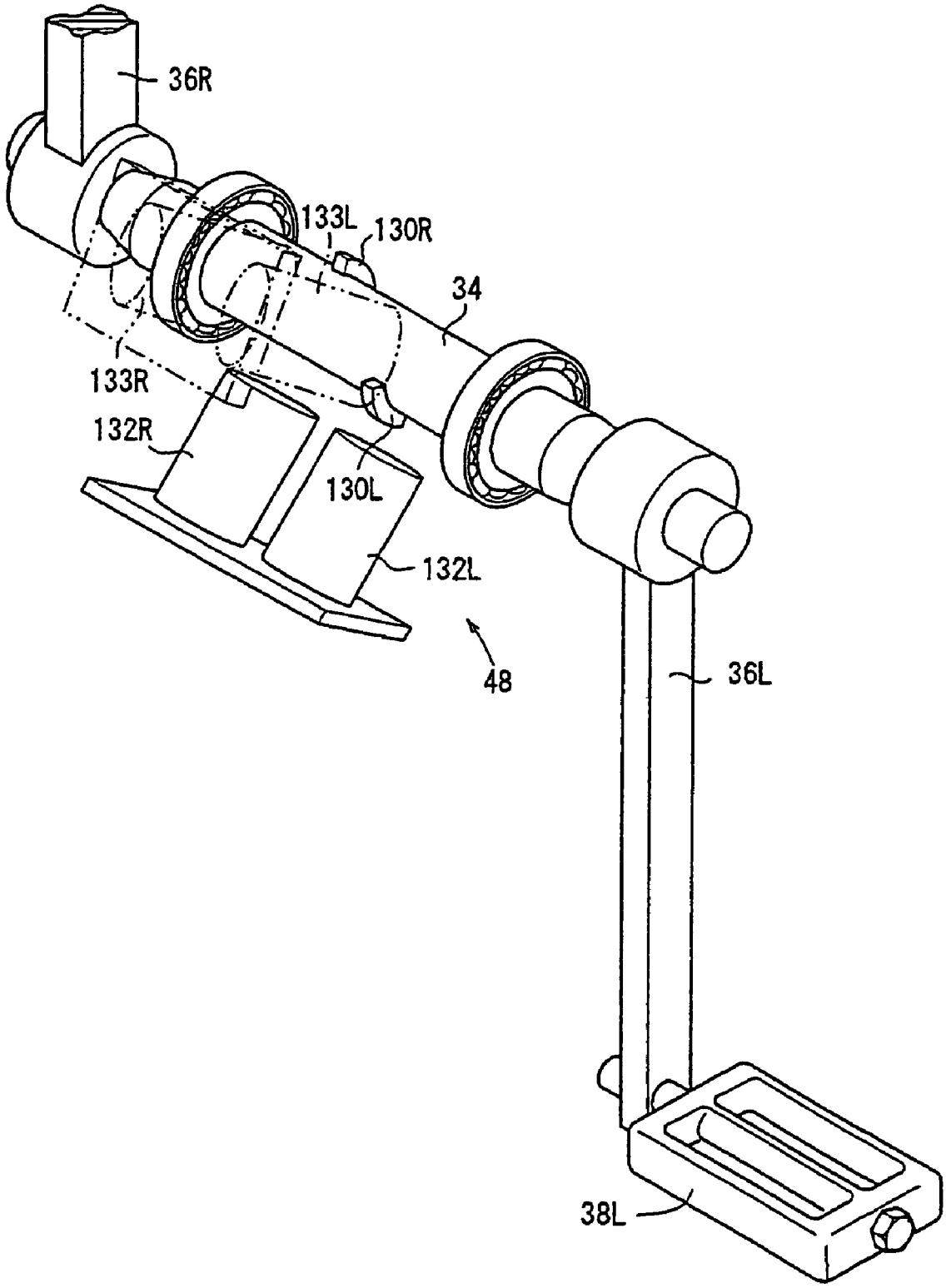
FIG. 5 is a schematic perspective view of the driving force transmission section.

As shown in FIGS. 2, 3 and 5, the crank position detection section 48 has detection object projections 130L and 130R provided at positions leftwardly and rightwardly at equal distances from the center of the crankshaft 34. A left proximity sensor 132L and a right proximity sensor 132R are provided. The left proximity sensor 132L and the right proximity sensor 132R are provided in the proximity of the crankshaft 34 through a stay 133 and are disposed such that the detection object projections 130L and 130R pass in the proximity of the front of detection portions thereof. The left proximity sensor 132L and the right proximity sensor 132R may otherwise be attached directly to the frame 20 or a predetermined casing.

The left proximity sensor 132L and the right proximity sensor 132R are sensors for which, for example, a Hall element is used, and exhibit an on state when the detection object projections 130L and 130R, which are detection objects, are positioned in front of the detection portions thereof, respectively. Since the left proximity sensor 132L and the right proximity sensor 132R are used for the crank position detection section 48, the rotational positions of the cranks can be detected simply and readily with a less expensive configuration.

The detection object projections 130L and 130R are sectoral projections having an angle of 60° and centered at the crankshaft 34. The detection object projections 130L and 130R are attached such that, when the crank 36L is directed downwardly and the crank 36R is directed upwardly, the detection object projection 130L is directed to an angle (hereinafter referred to as reference angle) of 45° in the clockwise direction from the vertically downward direction in FIG. 2 while the detection object projection 130R is directed to another angle of 180° from the reference angle.

The left proximity sensor 132L and the right proximity sensor 132R are provided at positions at which they can detect, at the reference angle thereof, with the detection object projections 130L and 130R, respectively. In particular, when the crankshaft 34 rotates, while the center of the detection object projection 130L is within ±30° with respect to the reference angle, the left proximity sensor 132L exhibits an on state, but exhibits an off state in any other case. On the other hand, when the crankshaft 34, while the center of the detection object projection 130R is within ±30° with respect to the reference angle, the right proximity sensor 132R exhibits an on state, but exhibits an off state in any other case. In other words, the left proximity sensor 132L exhibits an on state when the crank 36L and the pedal 38L are within ±30° with respect to the downward direction, and the right proximity sensor 132R exhibits an on state when the crank 36R and the pedal 38R are within ±30° with respect to the downward direction. On-off signals detected by the left proximity sensor 132L and the right proximity sensor 132R are supplied to the sub-control section 58.

Further, a left proximity sensor 133L for detecting the detection object projection 130L and a right proximity sensor 133R for detecting the detection object projection 130R may be provided at a position of 90° in the clockwise direction from the reference angle as indicated by chain double-dashed lines in FIG. 5. Thus, when the left proximity sensor 133L is on, it can be detected that the crank 36L is directed horizontally forwardly, and when the right proximity sensor 133R is on, it can be detected that the crank 36R is directed horizontally forwardly. Consequently, for example, an image of the crank of the bicycle displayed on the screen 14*a* and an image of the feet of the rider can be displayed like an animation by varying them stepwise in response to the actual angles of the cranks 36L and 36R, and a more realistic image is obtained.

Figure 6:
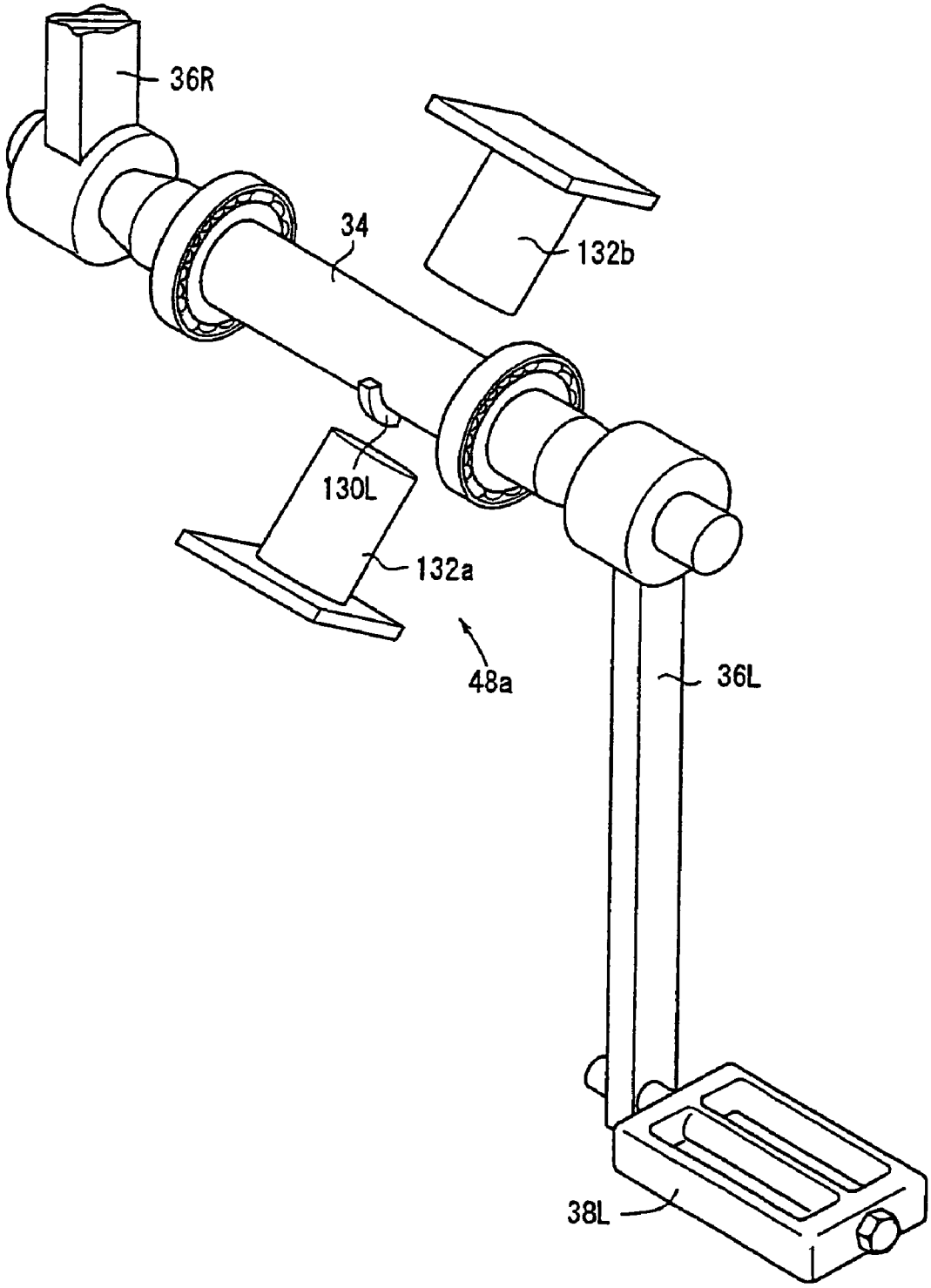
FIG. 6 is a schematic perspective view of a modification to the driving force transmission section.

Further, as shown in FIG. 6, a crank position detection section 48*a* according to a modification may be configured such that the detection object projection 130R is omitted while one detection object projection 130L and two proximity sensors 132*a* and 132*b* are provided such that the proximity sensor 132*a* and the proximity sensor 132*b* are disposed on the opposite sides of the crankshaft 34. In this instance, when the proximity sensor 132*a* which corresponds to the left proximity sensor 132L detects the detection object projection 130L and exhibits an on state, it can be detected that the left crank 36L is directed downwardly, and when the proximity sensor 132*b* which corresponds to the right proximity sensor 132R detects the detection object projection 130L and exhibits an on state, it can be detected that the crank 36R is directed downwardly. Furthermore, a rotational sensor such as a rotary encoder for detecting the angle of rotation of the crankshaft 34 precisely may be provided as the crank position detection section.

Figure 7:
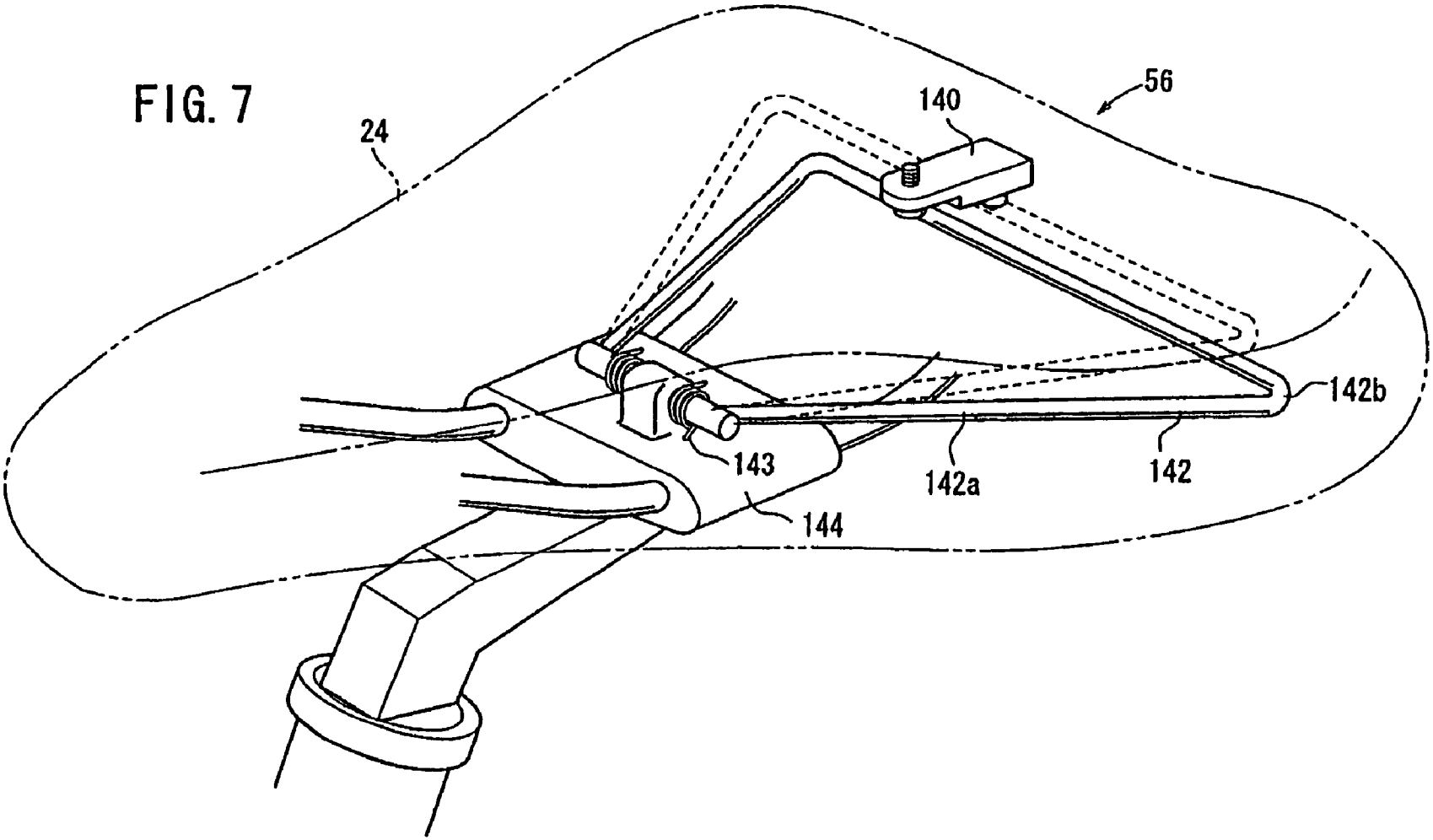
FIG. 7 is a partial perspective view of a saddle.

As shown in FIG. 7, the grip detection section 56 includes a retreating switch 140 in the form of a momentary type limit switch provided at a rear lower portion of the saddle 24, and a lever 142 for operating the retreating switch 140 on and off.

A front portion 142*a* of the lever 142 is supported for pivotal motion on a saddle support 144 while it is resiliently biased downwardly by a spring 143, and contacts with a predetermined stopper. A rear portion 142*b* of the lever 142 has a shape of a plate having a width substantially equal to that of a rear portion of the saddle 24 and is disposed below the retreating switch 140. The lever 142 can be operated to be lifted by a hand of a person while being acted upon by suitable reactive force by the spring 143, and can be lifted until the rear portion 142*b* is brought into contact with the retreating switch 140. As a result, the retreating switch 140 is switched on and supplies the on signal to the sub-control section 58. The lever 142 is operated while the rider is not on the bicycle simulation apparatus, and may be operated such that the rear portion 142*b* and a rear upper portion of the saddle 24 are grasped.

Since the retreating switch 140 is operated via the lever 142, the rider who is not on the bicycle simulation apparatus can easily operate the retreating switch 140. Further, since the retreating switch 140 is operated via the lever 142, the rear portion 142*b* which is an operation portion of the lever 142 can be disposed at a location at which the hand of the rider can reach most readily, and the degree of freedom in selection in design of the size, shape and number of the retreating switch 140 is high.

Since the grip detection section 56 is provided at a rear lower portion of the saddle 24, it does not provide an obstacle when the rider is seated on the saddle 24 and when the rider pedals the pedals 38L and 38R.

Since the retreating switch 140 is operated via the lever 142, the rider who is not on the bicycle simulation apparatus can readily operate the retreating switch 140, and the retreating switch 140 itself may be formed from a switch of a small size. Since the grip detection section 56 is provided at a rear lower portion of the saddle 24, it does not provide an obstacle when the rider is seated on the saddle 24.

As shown in FIG. 1, the mat switch 16 is composed of a left switch 150L and a right switch 150R independent of each other and is disposed at a position at which, when the rider gets off the bicycle simulation apparatus, the rider can tread the left switch 150L and the right switch 150R with both feet across a front tube 20*a* of the frame 20. In short, the left foot treads the left switch 150L, and the right foot treads the right switch 150R. When the left switch 150L and the right switch 150R are treaded, they are switched on and supply on signals to the sub-control section 58.

Figure 8:
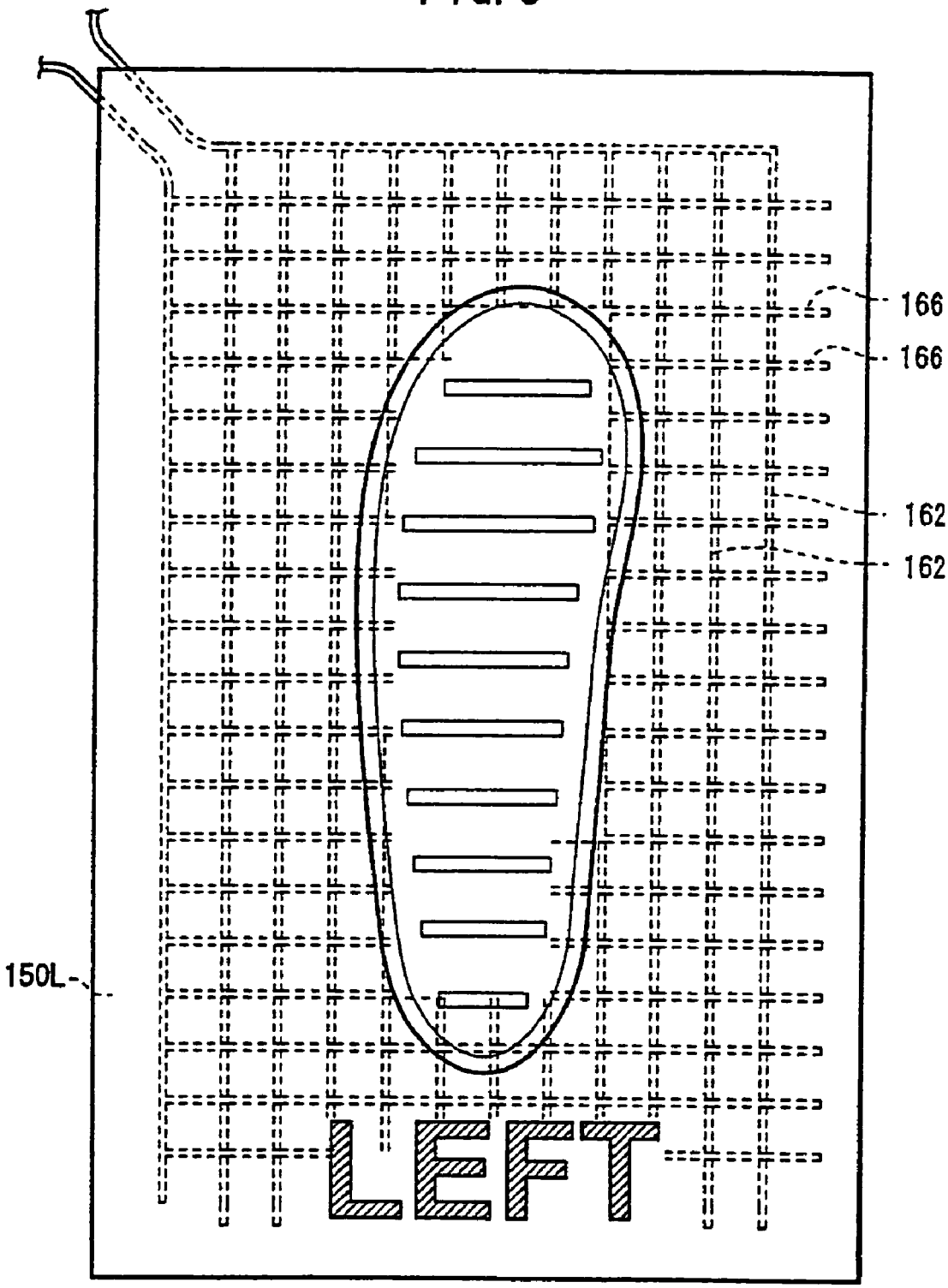
FIG. 8 is a plan view of a left switch.
Figure 9:
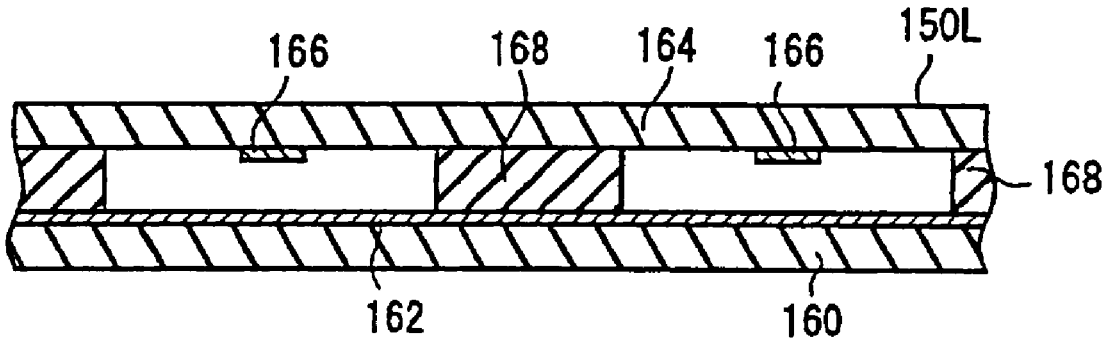
FIG. 9 is a sectional view of the left switch.

As shown in FIGS. 8 and 9, the left switch 150L is in the form of a thin mat and includes a rear face rubber sheet 160, a plurality of longitudinal electrode lines 162 adhered to the rear face rubber sheet 160, a front face rubber sheet 164, transverse electrode lines 166 adhered to the front face rubber sheet 164, and an insulating material 168 provided between the longitudinal electrode lines 162 and the transverse electrode lines 166. Each of the longitudinal electrode lines 162 is connected to one of two terminals (not shown), and each of the transverse electrode lines 166 is connected to the other terminal. The front face rubber sheet 164 and the insulating material 168 are soft and are resiliently deformed when the front face rubber sheet 164 is treaded by an individual's foot whereupon the longitudinal electrode lines 162 and the transverse electrode lines 166 are contacted with each other at intersecting portions thereof. Consequently, the two terminals are rendered conducting and exhibit an on state. On the other hand, if the foot is released, then the front face rubber sheet 164 and the insulating material 168 restore their original shapes, whereupon the longitudinal electrode lines 162 and the transverse electrode lines 166 are brought out of contact with each other and exhibit an off state. The front face rubber sheet 164 has a shape of the left sole and includes the designation "LEFT" printed thereon. The right switch 150R is same in structure as the left switch 150L and has a shape of the right sole and includes the designation "RIGHT" printed on the surface thereof.

While the left switch 150L and the right switch 150R are pressure sensitive type switches for detecting the load of a foot of the rider in this manner, they may be formed from a switch of any type such as the temperature sensitive type, infrared type, optical type or electrostatic capacity type only if it can detect that a rider's foot is placed thereon.

As shown in FIG. 10, the sub-control section 58 includes an input interface section 170, a driver section 172 and a first communication section 174 and principally acts as an interface between the electric mechanism of the simulated bicycle 12 and the main control section 18. The input interface section 170 is connected to the microphone 52 and the various sensors and performs an inputting of analog signals and digital signals. The driver section 172 controls the motor 96. The first communication section 174 transmits and receives various data to and from the main control section 18.

The main control section 18 includes a situation setting section 180 for setting a situation of a simulated ride, an arithmetic operation processing section 182 for performing an arithmetic operation process in response to a traveling situation, a display control section 184 for performing display control of the monitor 14, and a sound driver 186 for performing sound outputting of the speaker 15. The situation setting section 180 further includes a warning section 188 for issuing a predetermined warning to the rider, a speech recognition section 190 for recognizing speech of sound inputted from the microphone 52, and a second communication section 192 for performing communication control with the first communication section 174.

The main control section 18 includes a CPU (Central Processing Unit) for principally performing control, a ROM (Read Only Memory), a RAM (Random Access Memory) and a HD (Hard Disk) as storage sections, and so forth. The functioning sections of the main control section 18 shown in FIG. 10 are implemented by the CPU reading in a program recorded on the HD and executing the program in cooperation with the ROM, the RAM and predetermined hardware. Further, the main control section 18 is connected to a storage section 194 of a large capacity and can write and read various data into and from the storage section 194.

Figure 11:
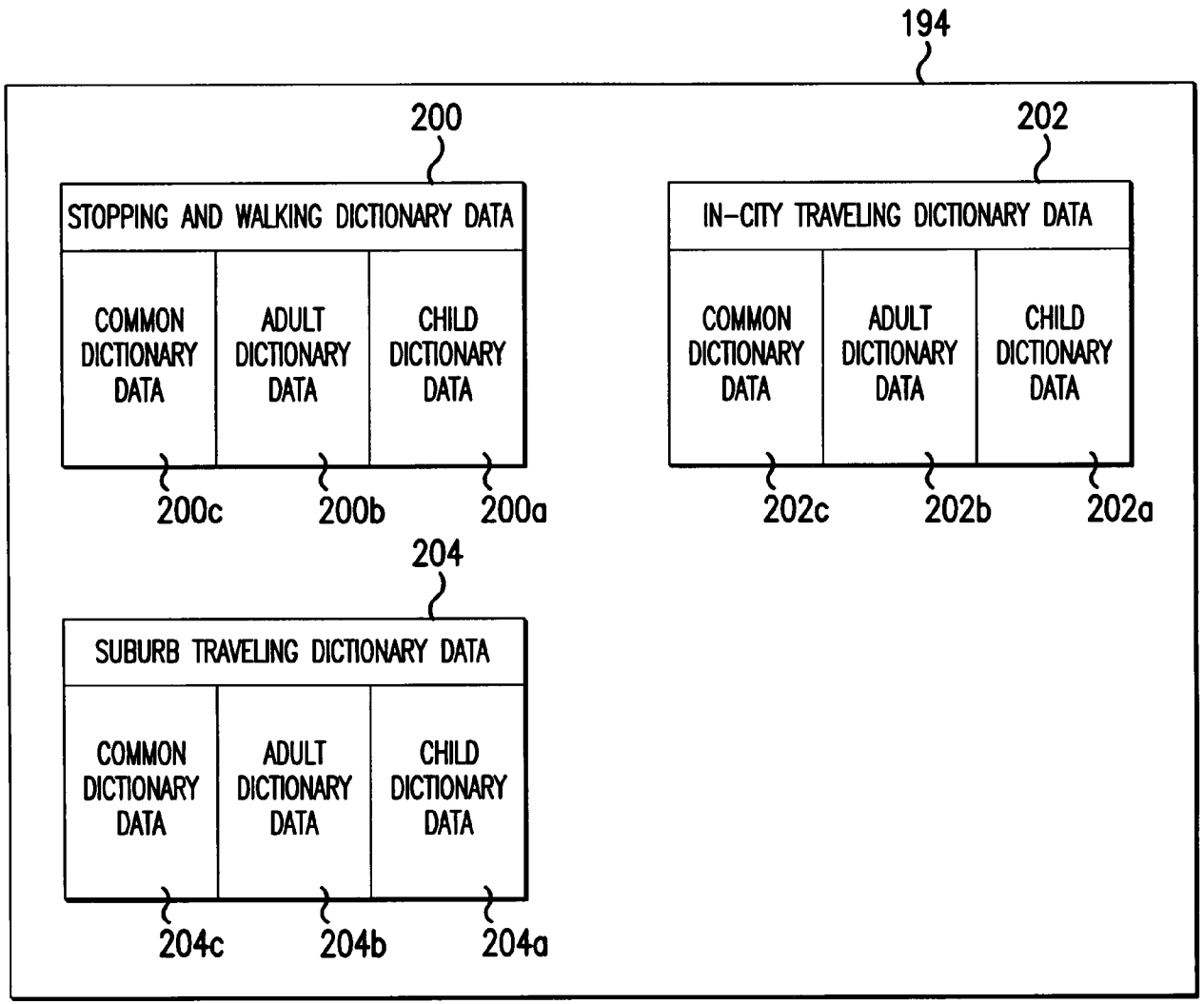
FIG. 11 is a diagrammatic view illustrating segmentation of dictionary data recorded in a storage section.

As shown in FIG. 11, three dictionary data for speech recognition corresponding to a walking mode, a retreating mode and a traveling mode, hereinafter described, are recorded in the storage section 194. In short, stopping and walking dictionary data 200 used in any mode other than the traveling mode, in-city traveling dictionary data 202 used when the rider travels in a city in the traveling mode and suburb traveling dictionary data 204 used when the rider travels in the suburbs in the traveling mode are provided in the storage section 194. The stopping and walking dictionary data 200 includes child dictionary data 200*a* used when the rider is a child, adult dictionary data 200*b* used when the rider is an adult and common dictionary data 200*c* used commonly for a child and an adult. Similarly, the in-city traveling dictionary data 202 includes child dictionary data 202*a*, adult dictionary data 202*b* and common dictionary data 202*c*, and the suburb traveling dictionary data 204 includes child dictionary data 204*a*, adult dictionary data 204*b* and common dictionary data 204*c*.

Each of the stopping and walking dictionary data 200, in-city traveling dictionary data 202 and suburb traveling dictionary data 204 (hereinafter referred to collectively as dictionary data) has a plurality of phrase data recorded therein and allows editing such as addition and deletion of phrase data in accordance with a predetermined procedure. Although each of the dictionary data is divided into a portion for a child and another portion for an adult, it may otherwise be divided for different languages (for example, Japanese and English).

As shown in FIG. 12, the in-city traveling dictionary data 202 includes a command column 206 and a process column 208, each of which is divided into and recorded as child dictionary data 202*a*, adult dictionary data 202*b* and common dictionary data 202*c*.

The command column 206*a* of the child dictionary data 202*a* has recorded therein phrase data such as "upper," "lower," "rear," "make heavier" and "make lighter" and in the process column 208 corresponding to the phrase data, and processes executed based on the phrase data are recorded. In particular, the process corresponding to "upper" is a "bird's eye view display" and indicates that a scene is displayed in a bird's eye view on the screen 14*a*. The process corresponding to "lower" is a "rider's eye view display" and indicates that a scene is displayed in a view of an eye of the rider on the screen 14*a*. The process corresponding to "make heavier" is an "increase of the load and an increase of the velocity coefficient" and indicates that the load to the flywheel 30 is increased and the velocity coefficient for calculating the simulation speed is increased. The process corresponding to "make lighter" is a "decrease of the load and a decrease of the velocity coefficient" and indicates that the load to the flywheel 30 is decreased and the velocity coefficient for calculating the simulation speed is decreased.

In the command column 206*b* of the adult dictionary data 202*b*, phrase data such as "bird's eye view," "rider's eye view," "shift-up" and "shift-down" are recorded, and processes are set and recorded so that the same processes as those of the "upper," "lower," "make heavier" and "make lighter" of the child dictionary data 202*a* are performed.

In the command column 206*c* of the common dictionary data 202*c*, phrase data such as "left" and "right" are recorded. The process corresponding to "left" is a "leftward screen display" and indicates that an image leftwardly of the rider at the point in time is displayed on the screen 14*a*. The process corresponding to "right" is a "rightward screen display" and indicates that an image rightwardly of the rider at the point in time is displayed on the screen 14*a*.

Also the stopping and walking dictionary data 200 and the suburb traveling dictionary data 204 have a format that is the same as that of the in-city traveling dictionary data 202 and have recorded therein processes necessary for stop and walking and for suburban traveling and phrase data for causing the processes to be executed. In the stopping and walking dictionary data 200 between them, phrase data same as "left" and "right" from among the phrase data mentioned are recorded, but such phrase data as "make heavier," "make lighter," "shift-up" and "shift-down" which are unnecessary upon stopping and upon walking are not recorded.

It is to be noted that, since each of the stopping and walking dictionary data 200, in-city traveling dictionary data 202 and suburb traveling dictionary data 204 acts such that the recognized speech of the rider is inputted and a predetermined speech command process (refer to FIG. 27) is outputted, it is also called a speech filter.

Now, a method of performing simulated riding of the bicycle using the bicycle simulation apparatus 10 having such a configuration as described above is described with reference to FIGS. 13 to 27. The following process relates to a process executed cooperatively by the main control section 18 and the sub-control section 58 after a predetermined power supply switch is turned on to start the main control section 18 and the sub-control section 58. In the following description, processing of the main control section 18 and processing of the sub-control section 58 are described without distinction therebetween, and unless otherwise specified, processing is performed in the order of the denoted step numbers.

Figure 13:
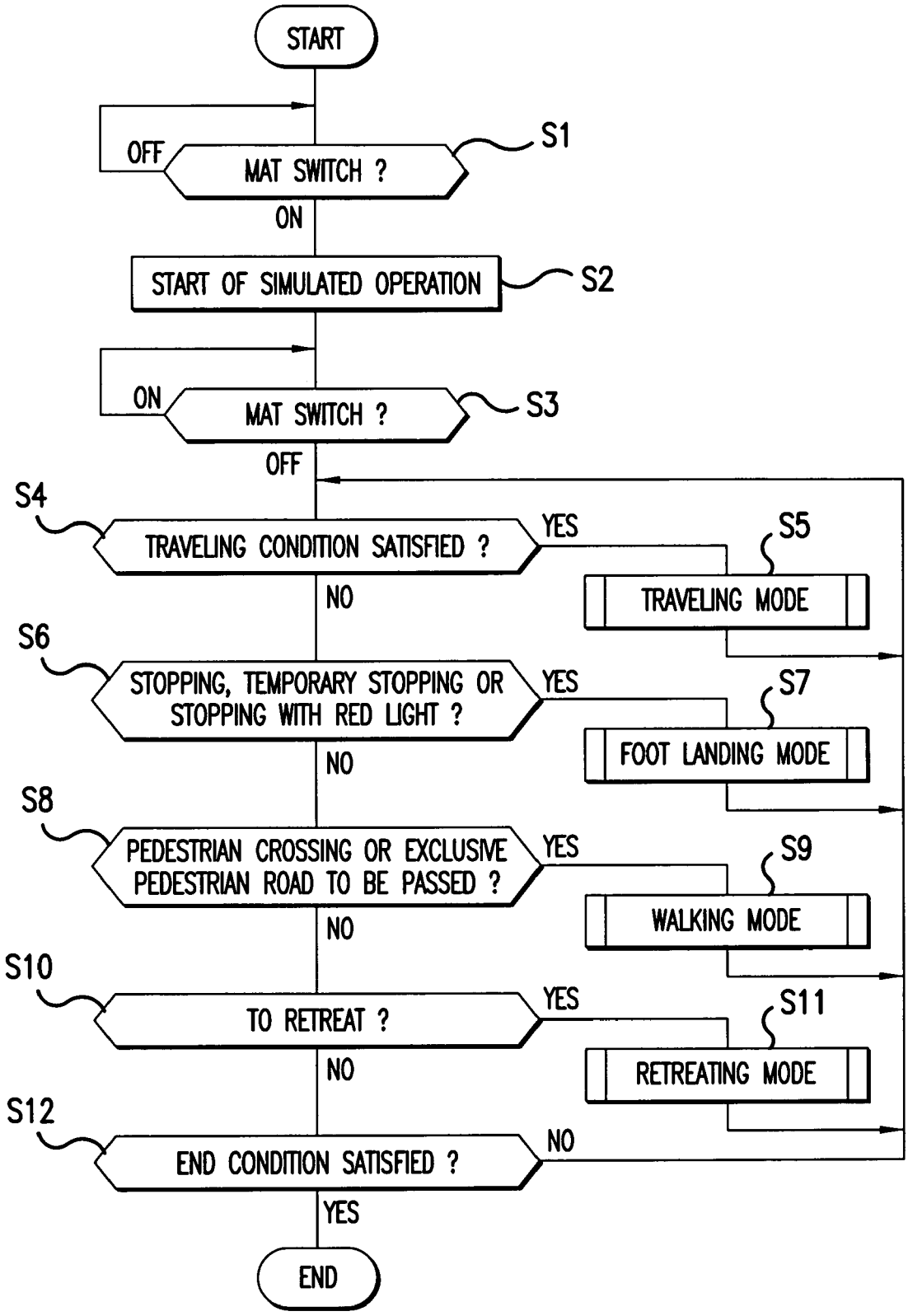
FIG. 13 is a flow chart of a main routine of a method of performing simulated operation of the bicycle using the simulation apparatus.
Figure 14:
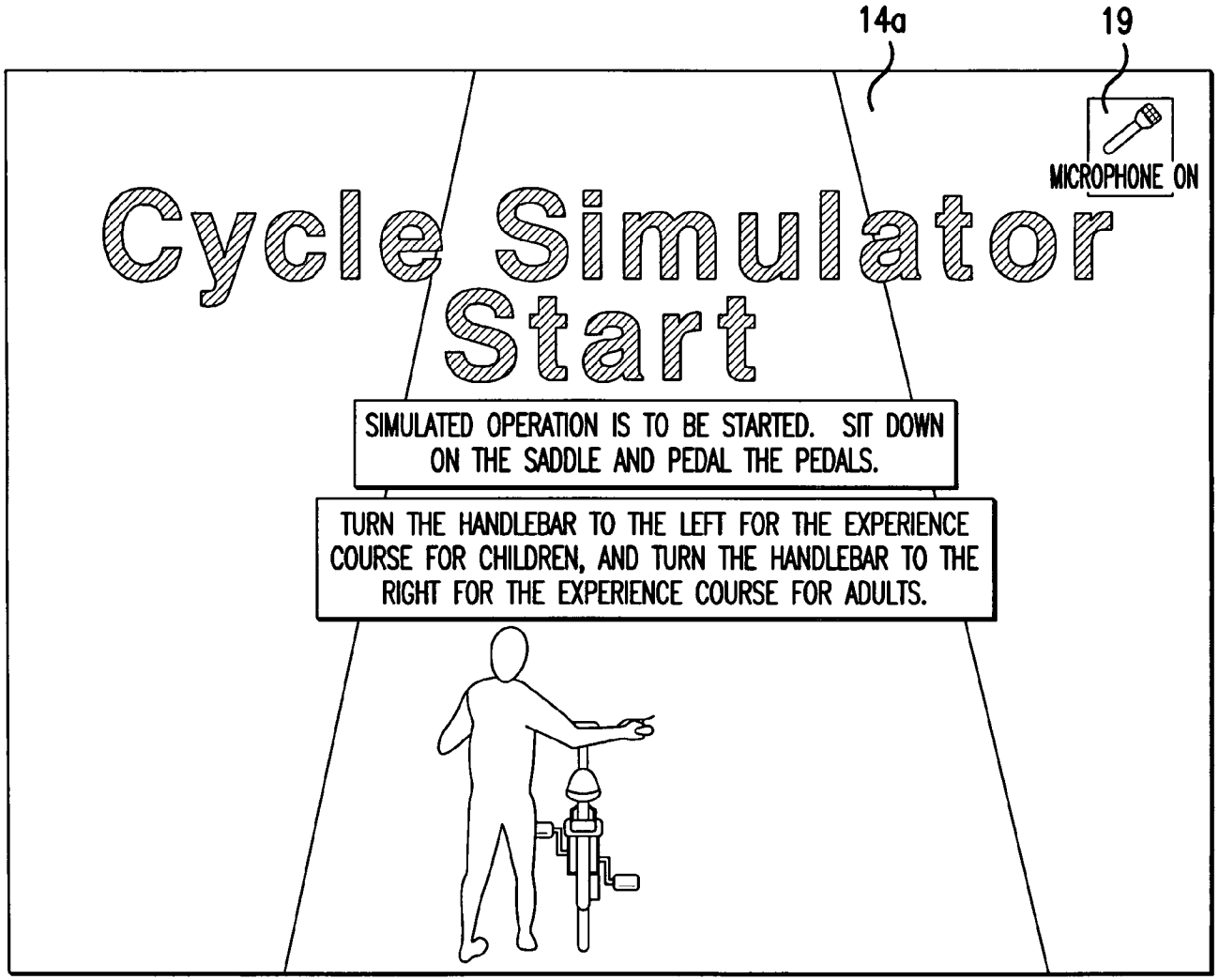
FIG. 14 is a view showing a start screen.

At step S1 of FIG. 13, it is confirmed whether or not the mat switch 16 is on. In particular, when at least one of the left switch 150L and the right switch 150R of the mat switch 16 is switched on, the processing advances to step S2, but when both of them are off, the processing stands by at step S1. In other words, if the rider stands on the mat switch 16, then the processing advances to step S2 automatically. Before then, the processing stands by at step S1 and the apparatus can be left in a predetermined power saving mode (for example, the monitor 14 is off).

At step S2, a simulated operation is started and a predetermined start screen (refer to FIG. 14) is displayed on the screen 14*a*. The start screen displays an image of a stopping bicycle and an image of a person who is the rider standing alongside the bicycle. Further, characters of "Simulated operation is to be started. Sit down on the saddle and pedal the pedals." are displayed on the screen 14*a*, or an audible statement is issued from the speaker 15 (hereinafter referred to collectively as "issue an instruction"). Further, an instruction of "Turn the handlebar to the left for the experience course for children, and turn the handlebar to the right for the experience course for adults." is issued.

In this manner, simulated operation can be started automatically by treading the mat switch 16, and a complicated operation is unnecessary and a simulated operation can be started without an unfamiliar feeling. Further, the rider may perform an operation in accordance with an instruction issued from the screen 14*a* or the speaker 15, and a manual or the like is unnecessary and an easy operation is possible. Thus, even a child can perform a simulated operation.

At step S3, it is confirmed whether or not the mat switch 16 is off. In particular, if both of the left switch 150L and the right switch 150R are off, then the processing advances to step S4, but if at least one of them is on, then the processing stands by at step S3.

In other words, if the rider is seated on the saddle 24 and removes his/her feet from the mat switch 16, then the processing advances automatically to step S4, at which time an actual traveling of the simulated operation can be started. At this time, the start screen described above is ended, and an image of the bicycle and an image of the person riding on the bicycle are displayed.

When it is recognized based on a signal of the steering angle sensor 50 that the handlebar 28 is operated to the left, it is decided that the experience course for a children is selected and the rider is a child. On the other hand, where it is recognized that the handlebar 28 is operated to the right, it is decided that the experience course for adults is selected and the rider is an adult. Then, a predetermined flag corresponding to the selected course is set.

At step S4, it is confirmed whether or not a predetermined traveling condition is satisfied. If the traveling condition is satisfied, then the processing advances to the traveling mode at step S5, but if the traveling condition is not satisfied, then the processing advances to step S6.

At step S6, it is confirmed whether or not the situation of the simulated operation is a stopping, temporary stopping or red light situation. If the situation of the simulated operation is a stopping, temporary stopping or red light situation, then the processing advances to a foot landing mode at step S7, but in any other case, the processing advances to step S8.

At step S8, it is confirmed whether or not the situation of the simulated operation is a situation where the bicycle is to pass a preferential pedestrian road such as a pedestrian crosswalk or an exclusive pedestrian road such as a sidewalk. When the bicycle is to pass a preferential pedestrian road or an exclusive pedestrian road, the processing advances to a walking mode at step S9, but in any other case, the processing advances to step S10.

At step S10, it is confirmed whether or not the situation of the simulated operation is a situation where the bicycle is to retreat. When the bicycle is to retreat, the processing advances to a retreating mode at step S11, but in any other case, the processing advances to step S12.

At step S12, it is confirmed whether or not a predetermined end condition is satisfied. If the end condition is satisfied, then the simulated operation is ended, but if the condition is not satisfied, then the processing returns to step S2 to continue the simulated operation. Also after the process at step S5, S7, S9 or S11 the processing returns to step S2.

When the simulated operation is to be ended, it is confirmed whether or not the mat switch 16 is on similarly as at step S1 described above. In this instance, since the mat switch 16 has been switched on, it can be detected that the rider gets off the simulated bicycle 12, and the simulated operation is ended based on the detection and the standby state such as the predetermined power saving mode is restored. It is to be noted that, if no operation of the simulated bicycle 12 is performed within a predetermined period after the mat switch 16 is turned off at step S2 described hereinabove, it is considered that the rider who treads the mat switch 16 has left the simulated bicycle 12 without getting on the simulated bicycle 12, also in this instance, the standby state may be restored.

Now, the traveling mode is described. The traveling mode is a mode wherein the rider seated on the saddle 24 pedals the pedals 38L and 38R and operates the handlebar 28 to perform simulated traveling.

Figure 15:
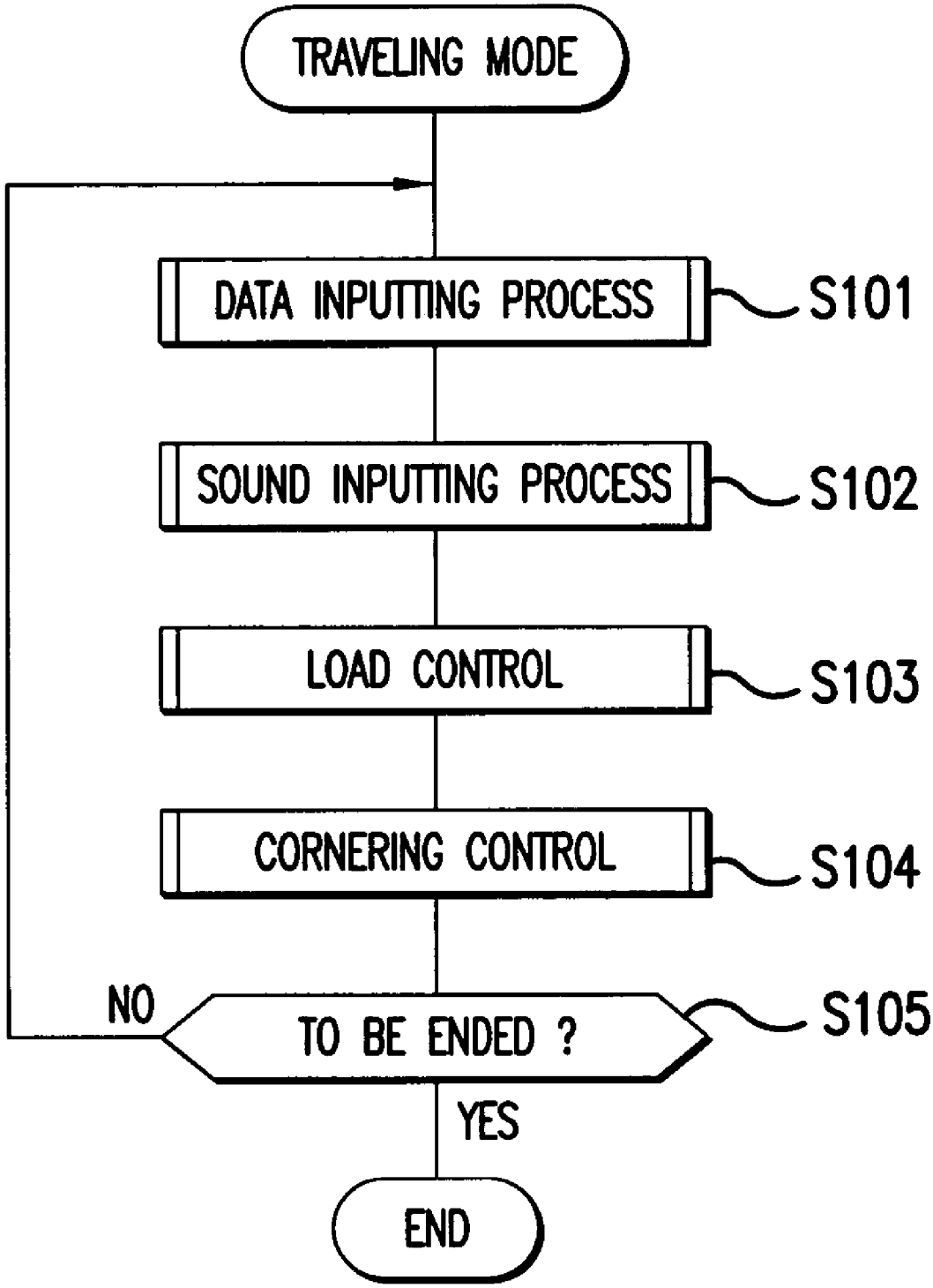
FIG. 15 is a flow chart of a traveling mode.

As seen in FIG. 15, in the traveling mode (at step S5 of FIG. 13), a data inputting process is performed first at step S101. In the inputting process, signals of the steering angle sensor 50, rotation sensors 106L and 106R, speed pickup 120, left proximity sensor 132L, right proximity sensor 132R and retreating switch 140 are read. For analog signals among the signals, predetermined AD conversion is performed, and the resulting digital signals are read.

Further, in the inputting process, data inputted from the speed pickup 120 is FV converted to determine a simulated traveling speed V. Thereupon, if the estimated gear ratio is high, then the speed of rotation of the flywheel 30 determined by the FV conversion is multiplied by a velocity coefficient higher than 1.0 corresponding to the gear ratio to determine the traveling speed V.

Figure 17:
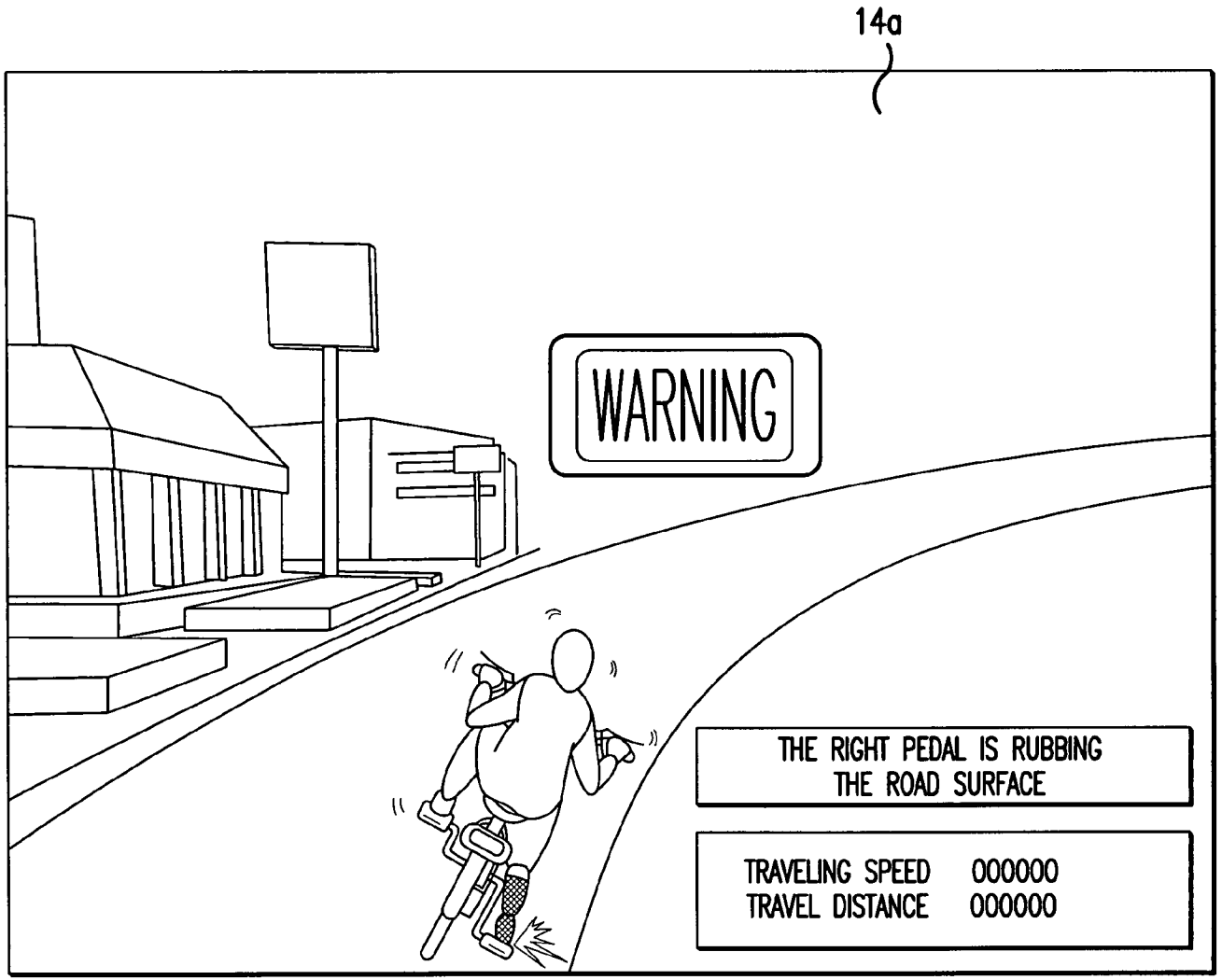
FIG. 17 shows a display on a screen illustrating a warning during cornering traveling.

Further, as occasion demands, a travel distance, maximum velocity, an average velocity, travel time and so forth should be determined and displayed on the screen 14*a* (refer to FIG. 17). Further, as occasion demands, the speed of rotation of the crankshaft 34 may be determined from the left proximity sensor 132L and the right proximity sensor 132R and displayed on the screen 14*a*. If the speed of rotation by the feet of the rider that is displayed on the screen 14*a* is changed in response to the speed of rotation of the crankshaft, then a more realistic image is obtained. To keep the speed of rotation of the crankshaft to be significant for the body upon the traveling of a bicycle over a long distance, and display of the speed of rotation of the crankshaft on the screen 14*a* is preferable to a training application.

The traveling speed V is not necessarily determined by the speed detection section 46 but may be based on a parameter generated by the rider pedaling the pedals 38L and 38R. For example, the traveling speed V may be estimated from the speed of rotation of the crankshaft described above and signals of the rotation sensors 106L and 106R are representative of an amount of brake operation.

At step S102, a sound inputting process is performed under the action of the speech recognition section 190 to recognize the speech of the rider inputted from the microphone 52. Detailed contents of the sound inputting process are hereinafter described.

At step S103, a load control for the flywheel 30 is performed. In the load control, when the situation of the simulated operation is acceleration or uphill traveling, the load is increased, but when the situation of the simulated operation is flat road traveling or downhill traveling, the load is decreased. Further, the load is increased substantially in proportion to a sum value of a signal of the rotation sensor 106L and a signal of the rotation sensor 106R. Since the signals of the rotation sensors 106L and 106R are interlocked with a braking operation, the load is increased to provide a braking action by such braking operation.

The load to the flywheel 30 is adjusted by adjusting the tilting angle of the load plate 90 under the action of the motor 96 to change the distance between the ferrite magnets 98 and the rim 30*a* as described hereinabove.

At step S104, cornering control is considered when the traveling situation is cornering (including traveling at a corner of a street, U-turn and so forth). Detailed contents of the cornering control are hereinafter described.

At step S105, a predetermined condition is checked to determine whether or not the traveling mode should be ended. When the traveling mode should be continued, the processing returns to step S101 described hereinabove.

It is to be noted that, while the traveling mode is being executed, the signal of the mat switch 16 is checked, and if the mat switch 16 is turned on during traveling during which the traveling speed V is not 0, then an instruction of "Don't land your foot during traveling." should be issued. In order to end the simulated operation of the bicycle simulation apparatus 10, it is only necessary for the rider to tread the mat switch 16 and there is no necessity to perform a special operation.

On the other hand, separately from the process of the traveling mode illustrated in FIG. 15, a process of the display control section 184 is executed simultaneously and parallel by a multi-task processing. The display control section 184 executes control for changing the scene to be displayed on the screen 14*a* while performing a transmission and reception of data to and from an execution section of the traveling mode. In the display control, the scene to be displayed on the screen 14*a* is changed on the real time basis based on the traveling speed V determined at step S101 described hereinabove and the steering angle $\theta_H$ of the handlebar 28 detected by the steering angle sensor 50.

Further, the eye point of the scene displayed on the screen 14*a* is changed based on the speech obtained at step S102 described hereinabove, and if the speech is "left," then a scene estimated to be a scene on the left of the rider is displayed. However, if the speech is "right," then a scene estimated to be a scene on the right of the rider is displayed. If the speech is "front," then the display of a scene on the front of the rider is restored.

Further, if the speech is "upper," then a scene when the front is viewed from a bird's eye view point at an oblique rear position is displayed together with an image of the bicycle and an image of the person riding on the bicycle. If the speech is "lower," then a scene when the front is viewed from the view point of the rider is displayed. If the speech is "rear" (back), then a scene when the front is viewed from a virtual vehicle traveling rearwardly.

The display control section 184 executes also the foot landing mode, walking mode and retreating mode simultaneously and parallel as multi-tasks and performs a display of the screen 14*a* on the real time basis.

Figure 16:
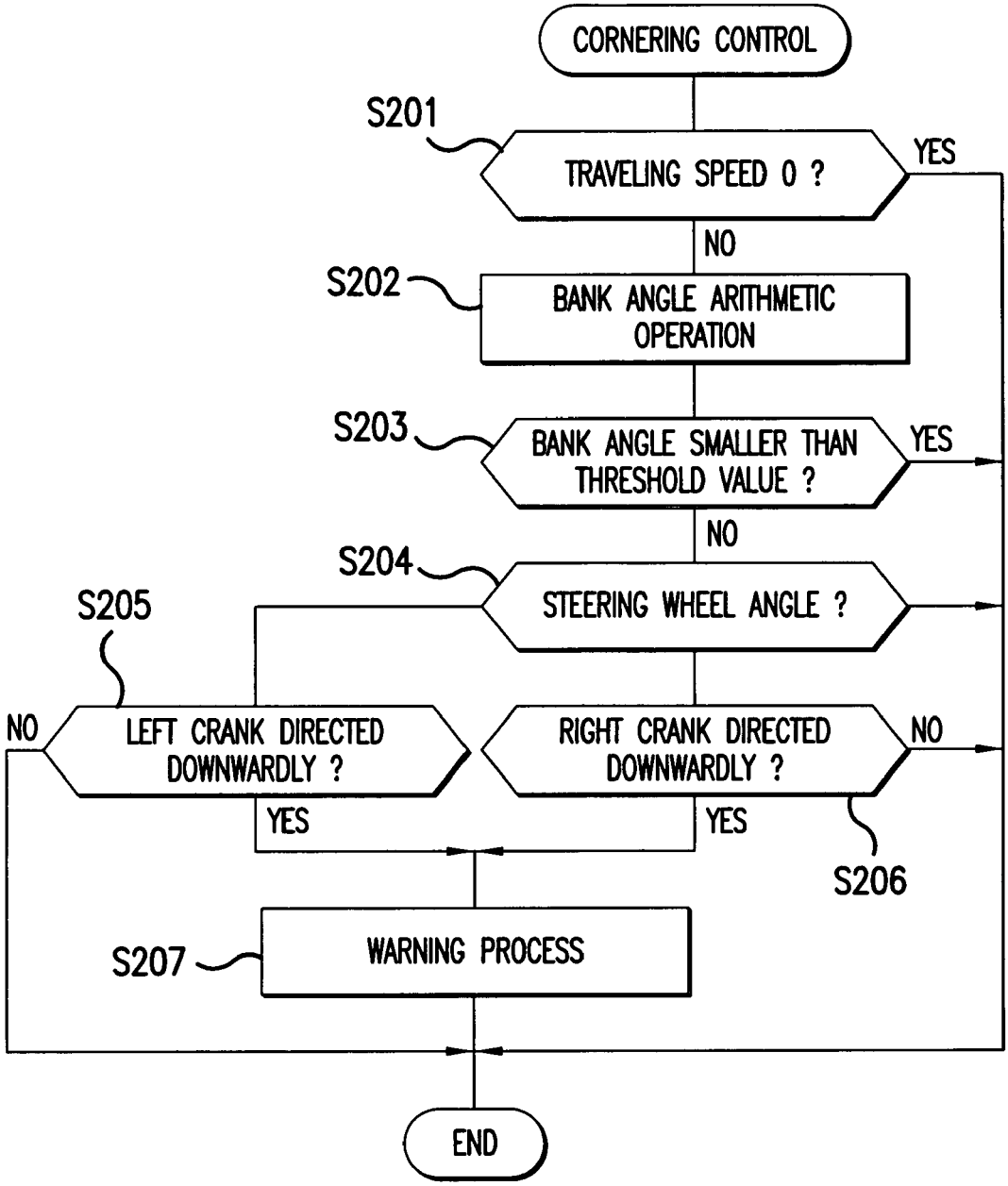
FIG. 16 is a flow chart of cornering control.

As shown in FIG. 16, in the cornering control (at step S104 of FIG. 15) in the traveling mode, it is confirmed first at step S201 whether or not the traveling speed V is 0. If the traveling speed V is 0, since the bicycle is in a stopping state, the cornering control process is ended. However, if V>0, then it is determined that the bicycle is traveling and the processing advances to step S202.

At step S202, a simulated bank angle $\theta_B$ is determined from the traveling speed V and the steering angle $\theta_H$, of the handlebar 28. By determining the bank angle $\theta_B$ and creating various traveling situations, a simulated operation which provides a feeling of presence can be anticipated.

At step S203, it is confirmed whether or not the bank angle $\theta_B$ is equal to or higher than a predetermined threshold value. If the bank angle $\theta_B$ is equal to or higher than the threshold value, then the cornering control is ended, but if the bank angle $\theta_B$ is lower than the threshold value, then the processing advances to step S204.

At step S204, the steering angle $\theta_H$ of the handlebar 28 is confirmed. If the steering angle $\theta_H$ is 0, then since the bicycle is traveling in a straightforward direction, the cornering control process is ended. If the steering angle $\theta_H$ has a positive value and the bicycle is being steered to in the leftward direction, then the processing advances to step S205. However, if the steering angle $\theta_H$ has a negative value and the bicycle is being steered to in the rightward direction, then the processing advances to step S206.

At step S205, it is confirmed whether or not the left crank 36L is directed downwardly. More particularly, when the left proximity sensor 132L is on, since the crank 36L is directed downwardly, the signal of the left proximity sensor 132L is checked. If the signal is on, then the processing advances to step S207. However, if the signal is off, then the cornering control process is ended.

At step S206, it is confirmed whether or not the right crank 36R is directed downwardly. More particularly, when the right proximity sensor 132R is on, since the crank 36R is directed downwardly, the signal of the right proximity sensor 132R is checked. If the signal is on, then the processing advances to step S207. However, if the signal is off, then the cornering control process is ended.

At step S207, a warning process is performed. In particular, the step S207 corresponds to a case wherein the bicycle is cornering and the bank angle $\theta_B$ is equal to or greater than the predetermined angle and, in addition, the crank 36L or 36R which is on the inner side of the corner is directed downwardly. Therefore, the situation of the simulated operation is such that the pedal 38L provided at the end of the crank 36L or the pedal 38R provided at the end of the crank 36R rubs the road surface. By issuing such a situation as just described as a warning, the bicycle simulation apparatus can cause the rider to learn a basic operation method of a bicycle so that improper operation may not be performed.

This warning is performed by the warning section 188 (refer to FIG. 10) cooperating with the display control section 184 and the sound driver 186 such that simulated sound generated when the pedals 38L and 38R rub the road surface is generated by the speaker 15 and the display control section 184 causes an image of the bicycle and a person riding on the bicycle and being rocked to be displayed on the screen 14*a* (refer to FIG. 17). Further, on the image, particularly the pedal 38L or 38R which is rubbing the road surface may be emphasized by a flickering display, changed color display or the like. Further, the characters of "warning" or the like may be displayed in an emphasized fashion on the screen 14*a*.

By issuing a warning to the rider through the visual and acoustic senses in this manner, the rider can feel as if the pedal 38L or 38R actually rubbed the road surface, and this is very effective in learning the operation of a bicycle.

Further, the method of warning may be selectively determined in accordance with the liking of the rider, and, for example, an electronic sound may be generated, or a message "a pedal is rubbing the road surface" may be audibly issued. Further, where the bicycle simulation apparatus 10 is used for a game, a demerit mark process of a score should be performed at step S207. This demerit mark process may be performed in various warning processes hereinafter described.

After this step S207, the cornering control process is ended. It is to be noted that, although, in the cornering control, only the state of the crank on the inner side of the corner is determined as an object of the detection. However, the state of the crank on the outer side of the corner which is the opposite side may be detected. In particular, since it is considered better to keep, during high speed cornering of a bicycle, the pedal on the outer side of the corner treaded down in a pressing fashion, a merit mark process or the like may be performed confirming that the crank on the outer side of the corner is lowered correctly.

At S207 which is a warning section at which a warning is issued in the cornering process, a warning may be issued when the handlebar 28 is operated by more than a predetermined amount in a direction that is the same as the direction in which the crank is lowered irrespective of the steering angle $\theta_B$. Or, a warning may be issued by searching a predetermined map based on the traveling speed V and the steering angle $\theta_H$.

Now, the foot landing mode is described. The foot landing mode is a mode for allowing the rider to stop the bicycle at a temporary stopping place or the like and touch the road surface with a foot thereof to perform a confirmation of a safety operation or the like.

Figure 18:
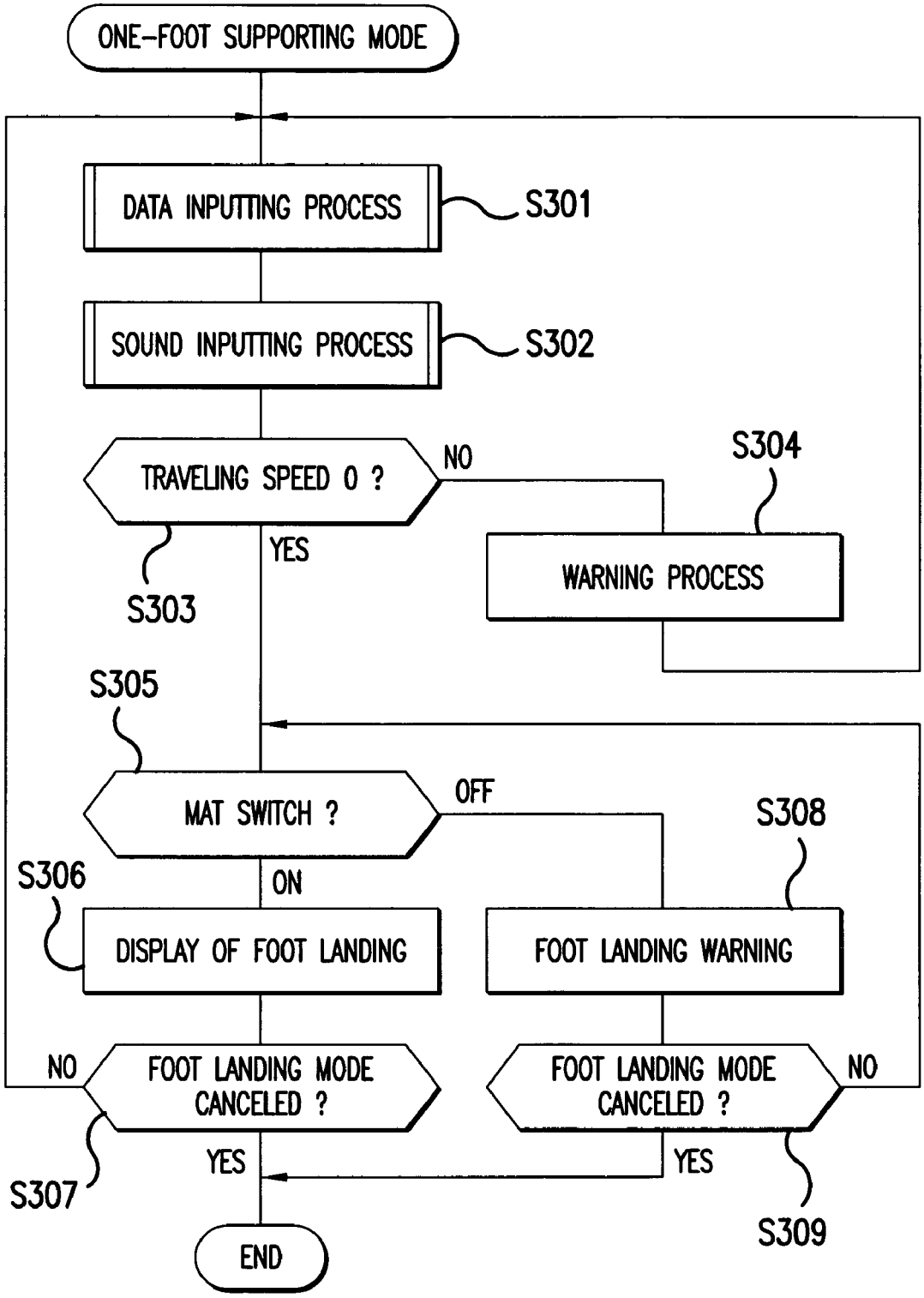
FIG. 18 is a flow chart of a foot landing mode.
Figure 19:
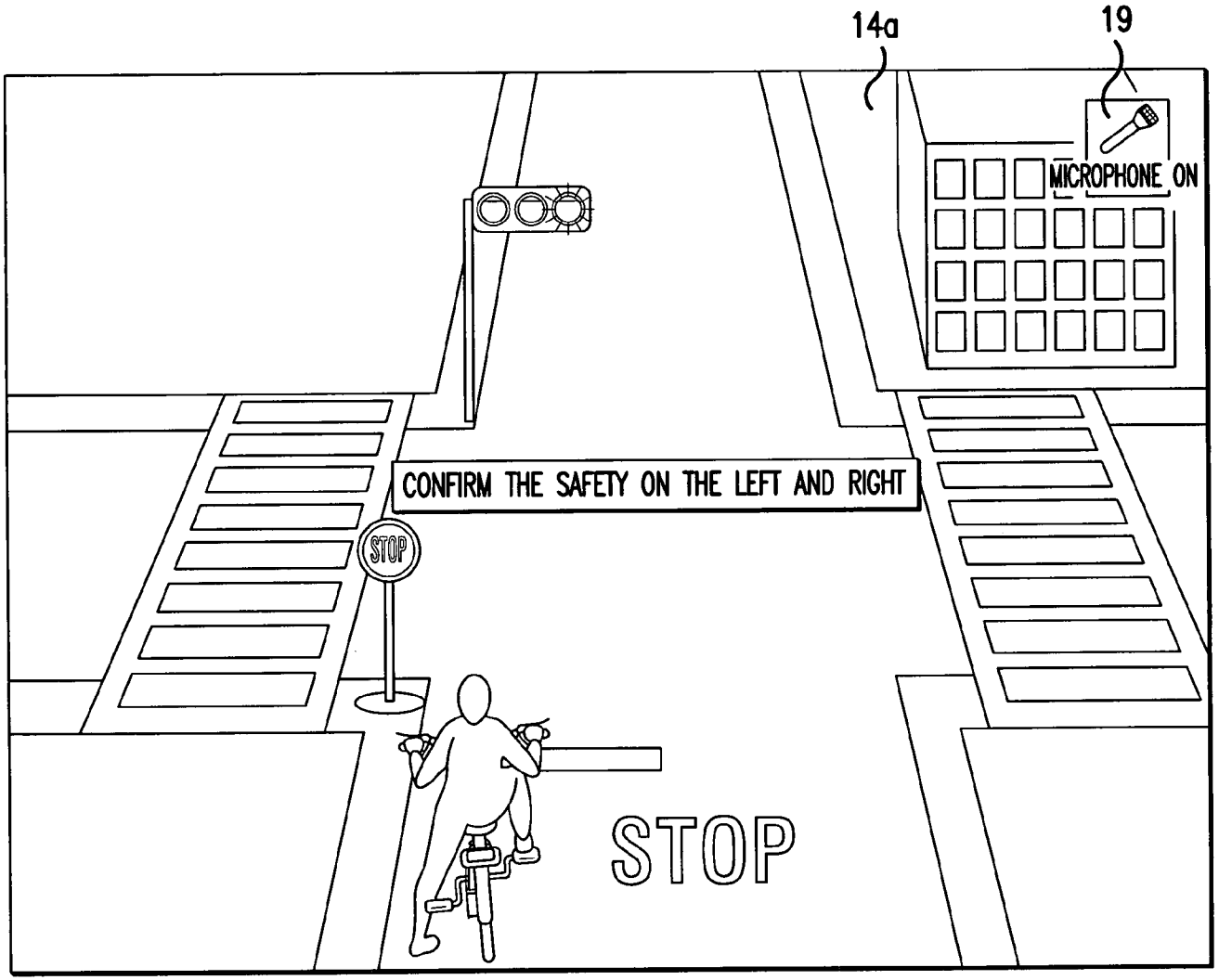
FIG. 19 shows a display on the screen illustrating a state wherein the bicycle temporarily stops in the foot landing mode.

As shown in FIG. 18, in the foot landing mode (at step S7 of FIG. 13), a data inputting process and a sound inputting process similar to those at steps S101 and S102 (refer to FIG. 15) described hereinabove are executed at steps S301 and S302, respectively.

At step S303, it is confirmed whether or not the traveling speed V is 0. If the traveling speed V is not 0, then a warning process is performed at step S304, whereafter the processing returns to step S301. In other words, the processing stands by while the processes at steps S301 to S304 are successively performed until after the traveling speed V becomes equal to 0. When the traveling speed V is 0, the processing advances to next step S305.

The warning process at step S304 is, for example, issuance of an instruction such as "brake the bicycle to stop" or the like. Further, if it is decided that the situation of the simulated operation is that the bicycle passes over the stop line at a crossing or the like, then a warning of a greater sound volume or a warning of a more emphasized display may be issued as a warning of a higher level or the simulated operation may be interrupted.

At step S305, it is confirmed whether or not the mat switch 16 is on (that is, whether or not at least one of the left switch 150L and the right switch 150R is on) a similar step as set forth in step S1 described hereinabove. If the mat switch 16 is on, then the processing advances to step S307. However, if the mat switch 16 is off, then the processing advances to step S308.

At step S306, an image of the bicycle and an image of a person who remains seated on the seat of the bicycle and places a foot thereof on the ground (refer to FIG. 19) are displayed on the screen 14*a* under the control of the display control section 184. Further, an instruction of "Confirm the safety on the left and right" is displayed on the screen 14*a*.

At step S306, for example, in order for the rider to confirm the safety on the left and right with certainty, the rider may be urged to utter "left" and "right." In this instance, the utterance is recognized by the speech recognition section 190, and left and right images at the temporarily stopping place are displayed on the screen 14*a*. If an approaching vehicle is displayed on any of the images, re-starting should be inhibited.

At step S307, it is confirmed whether or not the foot landing mode is canceled. If the one-foot standing mode is not canceled, then the processing returns to step S301 to continue the processing of the foot landing mode. However, if the foot landing mode is canceled, then the processing of the foot landing mode is ended. The foot landing mode is canceled, for example, when the traffic signal changes from red to green in the situation of the simulated operation or when the safety confirmation on the left and right is performed with certainty.

On the other hand, at step S308, although the traveling speed is 0, the rider is in a state wherein the rider does not land a foot thereof, and a foot-landing warning is issued. In particular, when the rider rides a two-wheeled vehicle including not only a bicycle but also a motorcycle or the like, it is significant for the safety education to stop with certainty with a foot landed at a location at which a traffic control signal for temporary stopping is present. In other words, such a situation as to only slow down or to temporarily stop without landing a foot and re-start the vehicle must be avoided. Accordingly, when it is confirmed based on the signal of the mat switch 16 that no foot is landed, a foot landing warning is issued.

Figure 20:
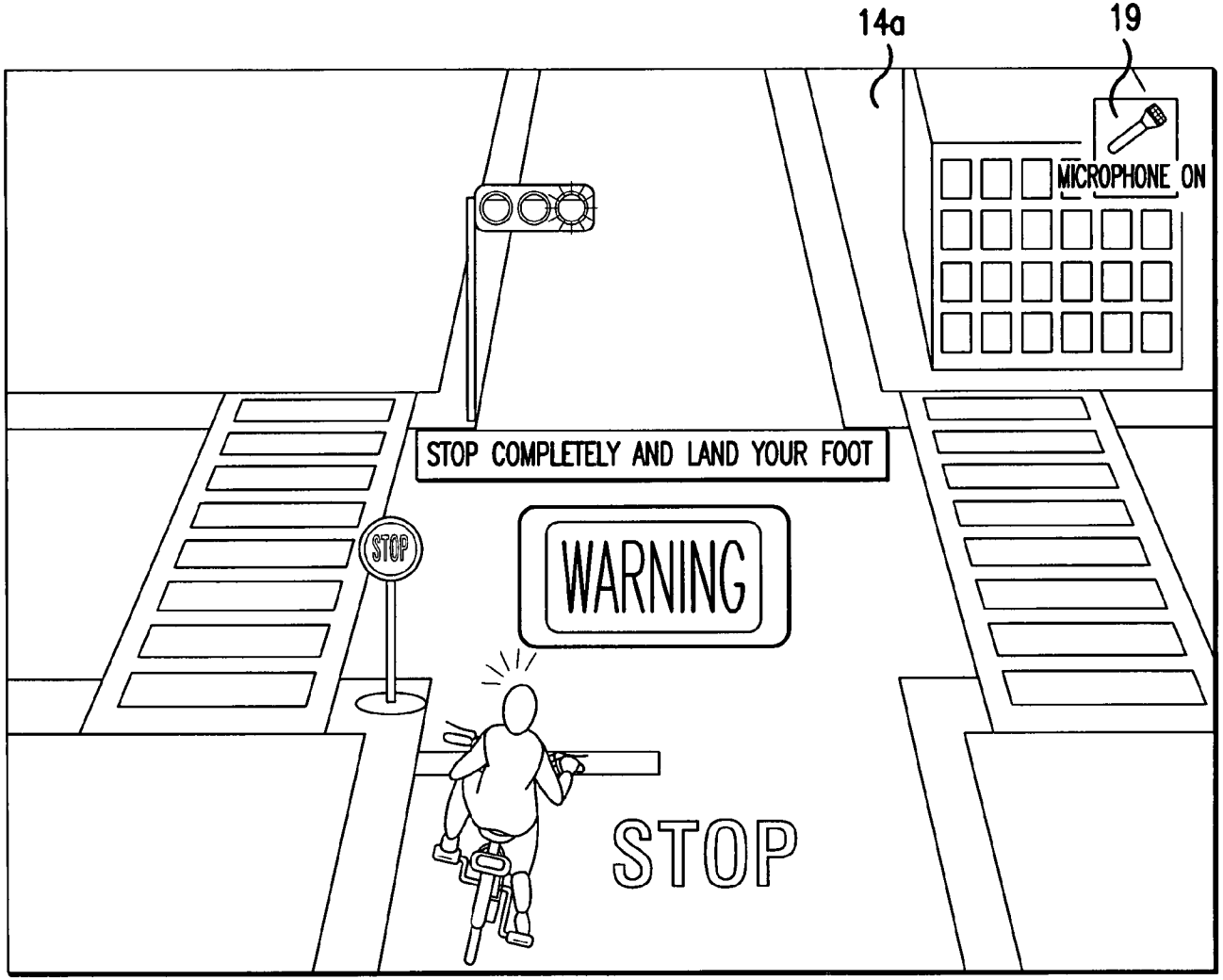
FIG. 20 shows a display on the screen which indicates a warning in the foot landing mode.

As the foot landing warning, an image that a bicycle and a person who rides on the bicycle have fallen down (or are rocked) should be displayed on the screen 14*a* under the control of the display control section 184 as seen in FIG. 20. Such an instruction as "Warning," "Stop fully and land your foot" or the like may be issued.

Further, the number of times by which the process at step S308 is executed may be counted such that, when the number of times exceeds a predetermined value, an image of a bicycle which falls down fully is displayed on the screen 14*a* and a warning of the high level described above is issued.

At step S309, it is confirmed whether or not the foot landing mode is canceled similarly as at step S307 described hereinabove. If the foot landing mode is canceled, then the processing of the foot landing mode is ended. However, if the foot landing mode is not canceled, then the processing returns to step S305.

Now, the walking mode is described. The walking mode is a mode for a situation wherein a rider walks pushing the bicycle on an exclusive pedestrian road or the like and is a mode for a situation wherein the rider learns, for example, such a manner of walking and pushing the bicycle wherein the rider does not provide an obstacle to the other pedestrians and so forth.

Figure 21:
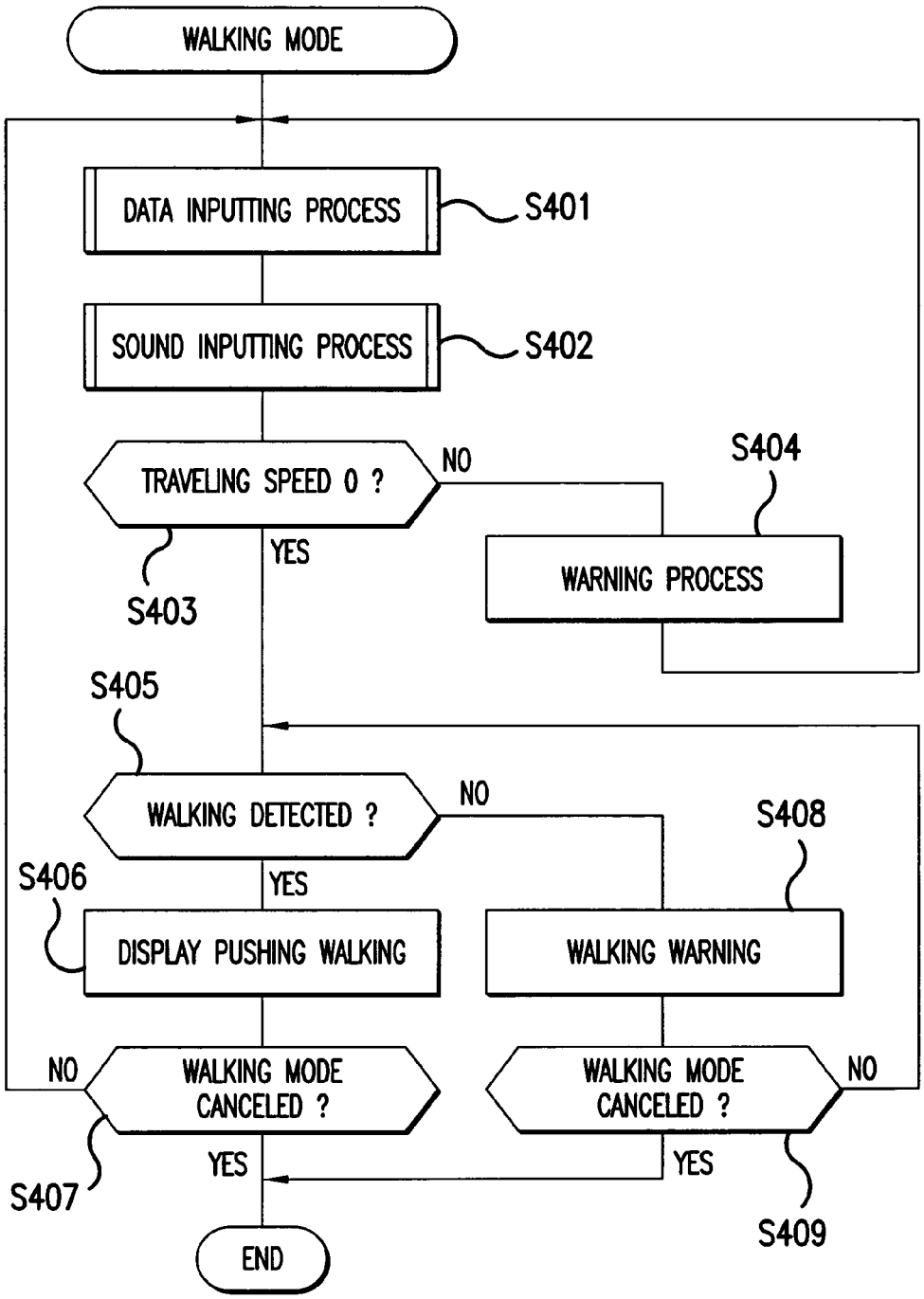
FIG. 21 is a flow chart of a walking mode.

As seen in FIG. 21, in the walking mode (at step S9 of FIG. 13), processes similar to those at steps S301 to S304 described hereinabove, that is, a data inputting process, a sound inputting process, a traveling speed confirmation process and a warning process, are executed at steps S401 to S404, respectively.

If the traveling speed V is 0 at step S403, then it is confirmed at step S405 whether or not the rider is walking. If such walking is detected, then the processing advances to step S406, but in any other case, the processing advances to step S408.

Figure 22:
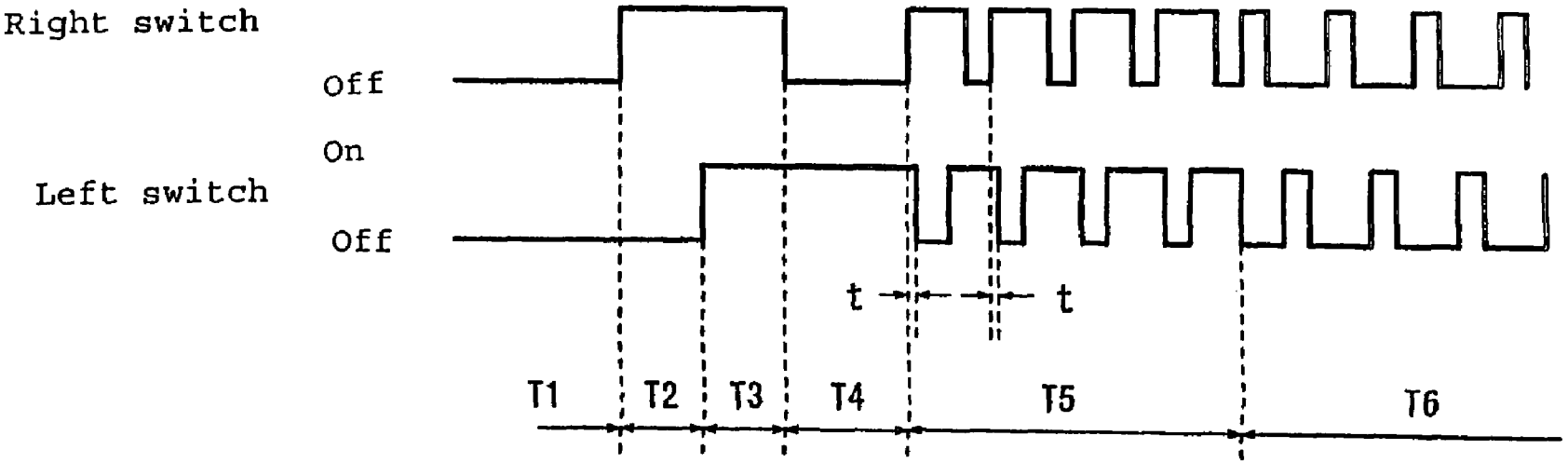
FIG. 22 is an input signal time chart of a right switch and a left switch of a mat switch.

The detection of walking in this instance is performed based on the signals of the left switch 150L and the right switch 150R as seen from FIG. 22, and within a period T1 within which both the left switch 150L and the right switch 150R continuously remain in an off state for more than a predetermined period of time, it is decided that the rider is riding on the bicycle. Within a period T2 and another period T4 within which only one of the left switch 150L and the right switch 150R continues to be on for more than the predetermined period of time, it is decided that one foot is landed. Within a period T3 within which both of the left switch 150L and the right switch 150R continue to be on for more than the predetermined period of time, it is decided that both feet are landed. Within a period T5 within which the left switch 150L and the right switch 150R alternately repeat on and off and a period t within which both of the left switch 150L and the right switch 150R exhibit an on state is involved, it is decided that the rider is walking and pushing the bicycle. Further, within a period T6 within which the left switch 150L and the right switch 150R alternately repeat on and off and a period within which both of the left switch 150L and the right switch 150R exhibit an on state is not involved, it is decided that the rider is running and pushing the bicycle.

If the period at step S405 is the period T5, then the processing advances to step S406, but if the period at step S405 is the period T1, T2, T3, T4 or T6, then the processing advances to step S408.

Figure 23:
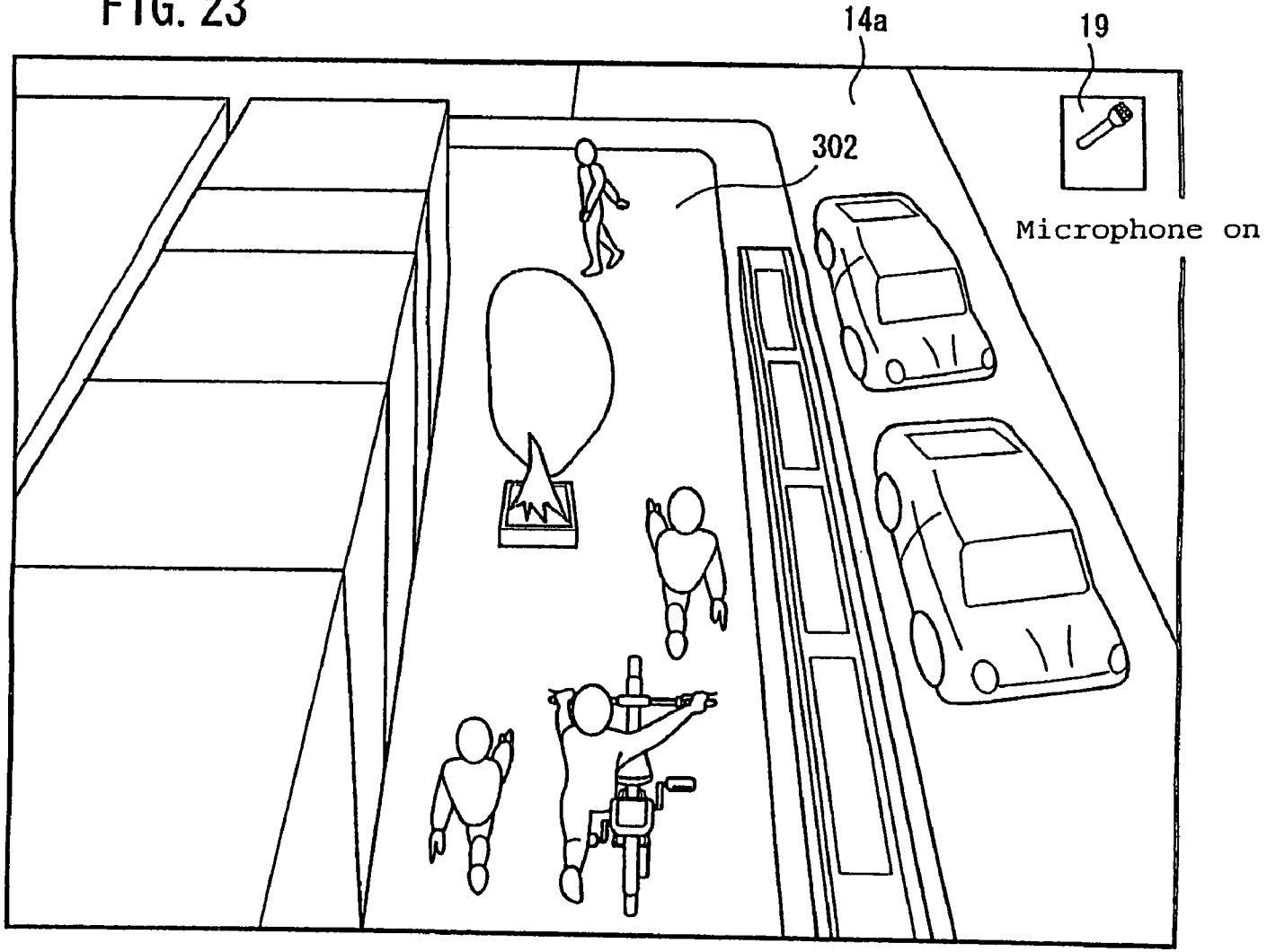
FIG. 23 shows a display on the screen in the walking mode.

At step 406, an image that the rider is getting off the bicycle is walking and pushing the bicycle is displayed on the screen 14*a* under the control of the display control section 184 (refer to FIG. 23). At this time, the advancing direction of the bicycle on the screen 14*a* may be changed based on the steering angle $\theta_H$ detected by the steering angle sensor 50. Further, the pushing walking and the pushing running may be determined distinctly to change the advancing speed.

At step S407, it is confirmed whether or not the walking mode is canceled. If the walking mode is not canceled, then the processing returns to step S401 to continue the processing of the walking mode. However, if the walking mode is canceled, then the walking mode process is ended. The walking mode is canceled, for example, when an end portion of the sidewalk or the pedestrian crossing along which the rider walks and pushes the bicycle is reached.

On the other hand, at step S408, the rider is not walking and pushing the bicycle, and a walking warning is issued. In particular, it is prescribed that, on the pedestrian road, a rider should walk and push a two-wheeled vehicle such as bicycle, and when the rider is not walking and pushing the bicycle, a predetermined warning is issued based on the signal of the mat switch 16.

The walking warning may be an issuance of an instruction such as "Warning," "Stop and walk pushing it,". "Walk" or "Don't run." Further, the number of times by which the process at step S408 is executed may be counted such that, when the number of times exceeds a predetermined value, a warning of the high level described hereinabove is issued.

At step S409, it is confirmed whether or not the walking mode is canceled similarly as at step S407 described hereinabove. If the walking mode is canceled, then the walking mode process is ended, but if the walking mode is not canceled, then the processing advances to step S405.

Figure 24:
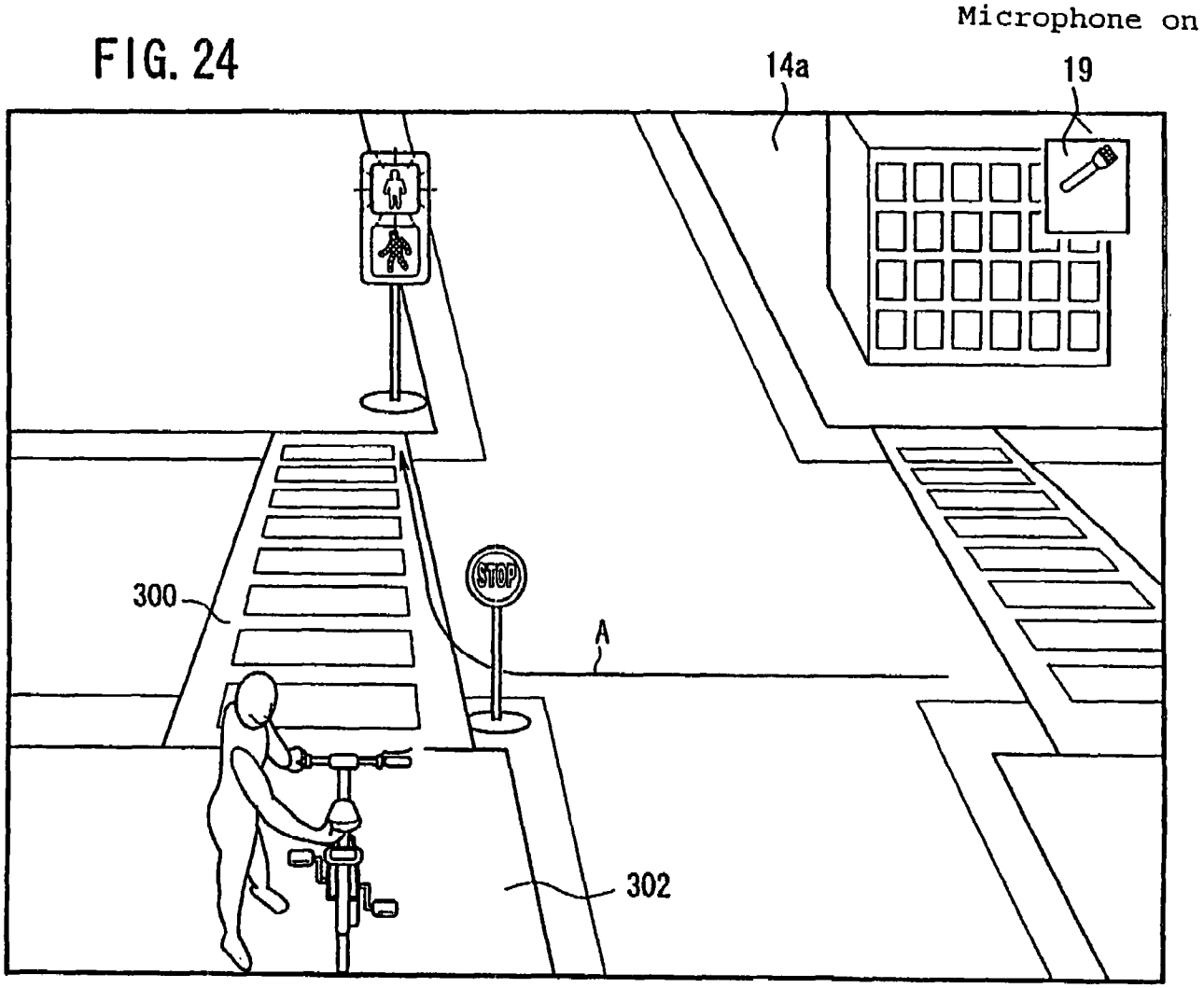
FIG. 24 shows a display on the screen illustrating a state wherein the bicycle retreats from a pedestrian crossing in a retreating mode.

Now, the retreating mode is described. The retreating mode is a mode in which the rider getting off the bicycle retreats from the pushing of the bicycle. For example, when the rider tries to turn to the right at a crossing while the bicycle is traveling on the left side of a roadway as seen in FIG. 24, the rider advances in a straightforward direction once and then changes the direction and walks and pushes the bicycle on a pedestrian crossing 300 as seen from a route indicated by an arrow mark A. However, if the traffic signal is red, then the rider must retreat in order to provide a refuge on a sidewalk 302.

Figure 25:
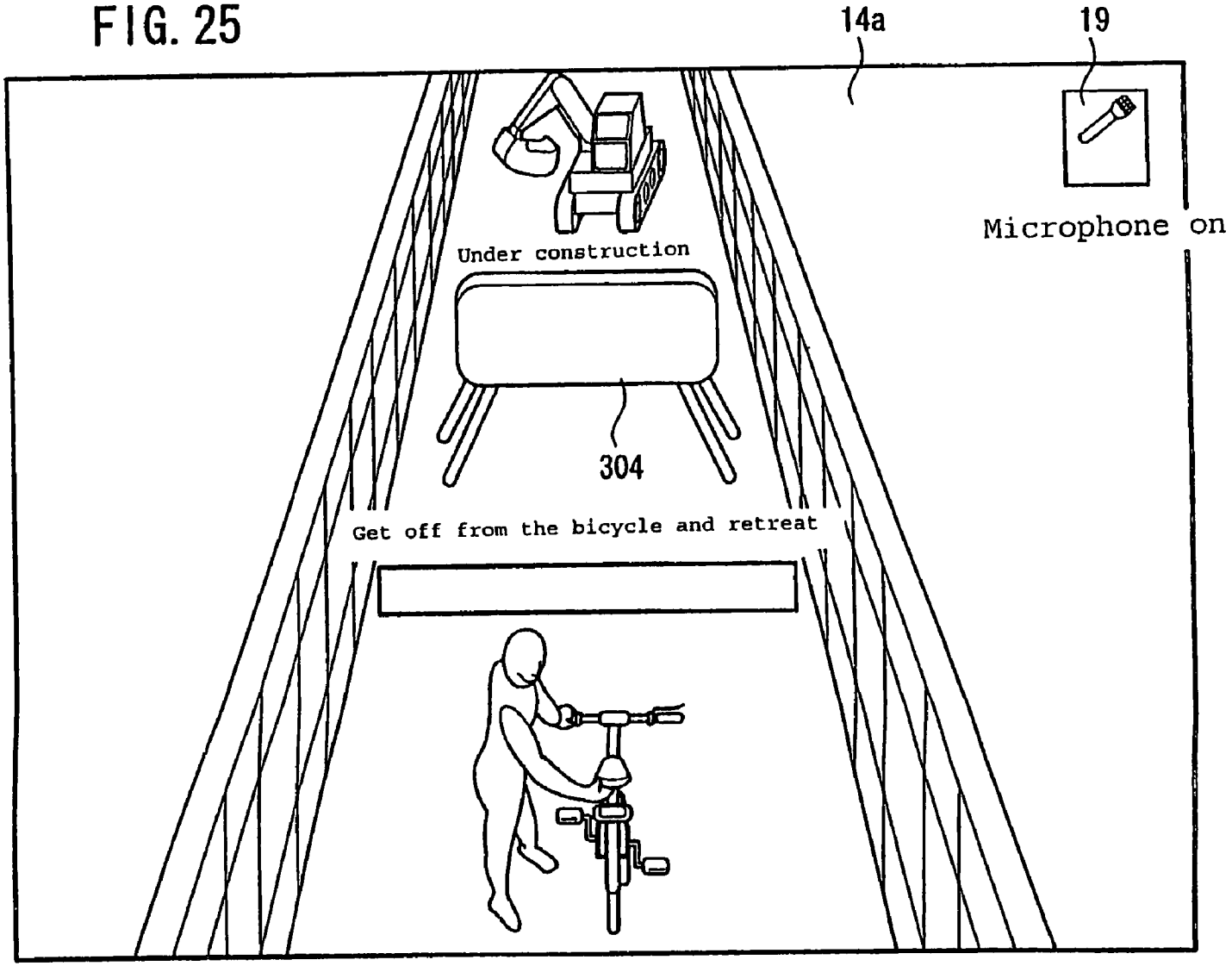
FIG. 25 shows a display on the screen illustrating a state wherein the bicycle retreats from the proximity of an obstacle in the retreating mode.

Further, if the bicycle comes excessively close to a simulated obstacle 304 positioned forwardly thereof as seen in FIG. 25, then since the bicycle cannot advance forwardly any more and must retreat, the retreating mode is entered. Also in a case other than the cases described, the retreating mode may be set to simulate a retreating movement such as a placement of a bicycle into or from a bicycle parking place.

Figure 26:
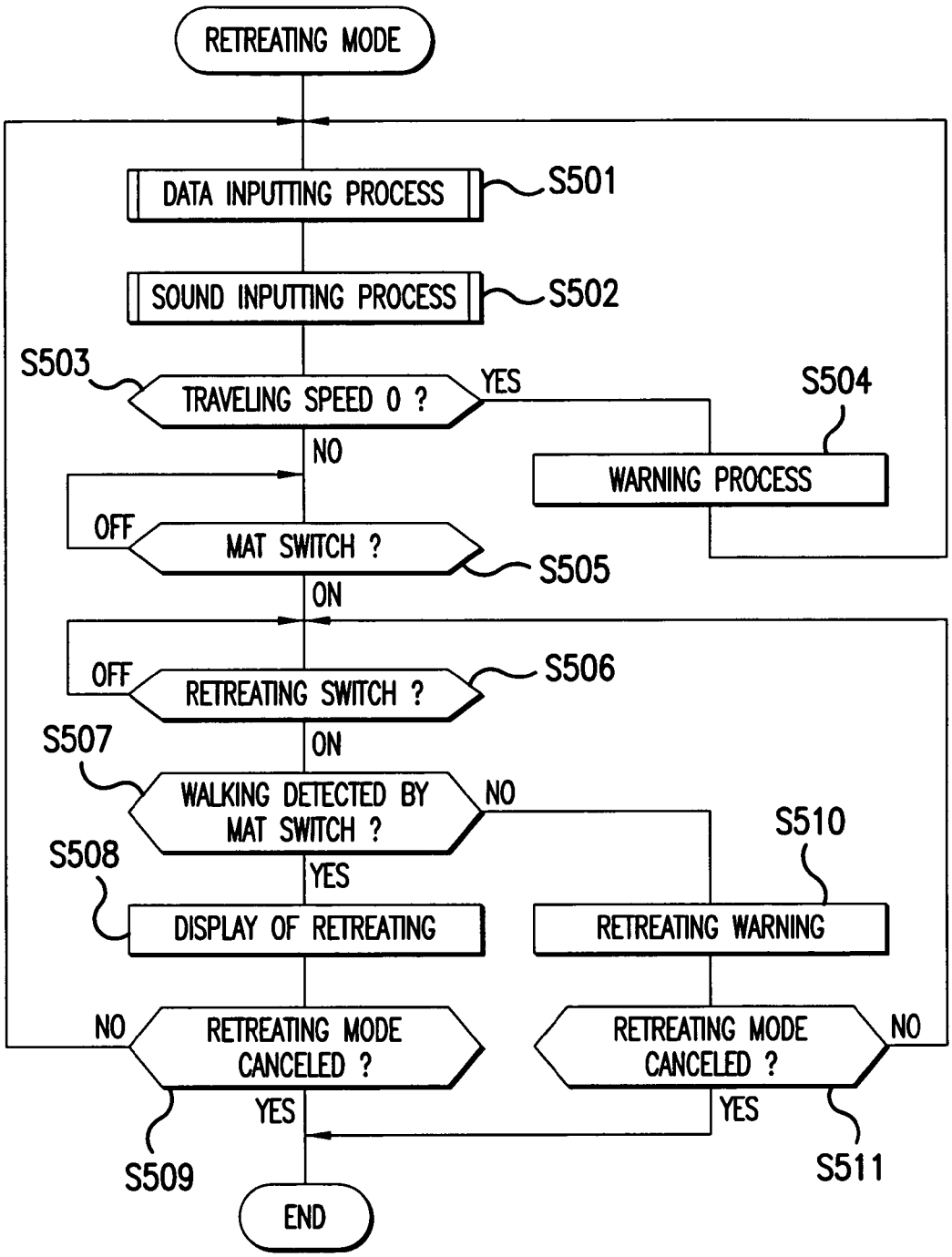
FIG. 26 is a flow chart of the retreating mode.

As seen in FIG. 26, in the retreating mode (at step S11 of FIG. 13), processes similar to those at steps S301 to S304 described hereinabove, that is, a data inputting process, a sound inputting process, a traveling speed confirmation process and a warning process, are executed at steps S501 to S504, respectively.

When the traveling speed V is 0 at step S503, it is confirmed at step S505 whether or not the mat switch 16 is on similar to the arrangement as set forth at step S1 described hereinabove. If the mat switch 16 is on, then the processing advances to step S506, but if the mat switch 16 is off, then the processing stands by at step S503.

At step S506, it is confirmed whether or not the retreating switch 140 is on. If the retreating switch 140 is on, then the processing advances to step S507, but if the retreating switch 140 is off, then the processing stands by at step S506. In particular, when the rider gets off the bicycle and pushes the bicycle rearwardly, it is common for the rider to retreat grasping a left portion of the handlebar 28 with the left hand and grasping the saddle 24 with the right hand (refer to the images of a person in FIGS. 24 and 25). This is because, if the rider tries to retreat while the rider grasps the handlebar 28 without grasping the saddle 24, then the handlebar 28 is pivoted at the portion of the head tube 26 and the retreating direction is not settled. Accordingly, a correct posture in which the rider grasps the saddle 24 together with the lever 142 to push the bicycle rearwardly is obtained. Since the retreating switch 140 is turned on at this time, if the signal of the retreating switch 140 is detected, then it can be recognized that the bicycle is prepared for a retreating movement.

Further, since the retreating switch 140 is provided at a rear lower portion of the saddle 24, when the rider is seated on the saddle 24 and performs an ordinary simulated traveling in the operating mode and so forth described hereinabove, the rider is not likely to touch the retreating switch 140. Thus, there is no possibility that the retreating switch may be operated in error. In other words, the retreating switch 140 is disposed at a position at which it can be operated readily only when the rider gets off the bicycle, and a retreating movement, which is performed by the rider getting off the bicycle, becomes more realistic.

At step S507, the detection of walking is performed substantially similarly as at step S405 described hereinabove, and when walking is detected, the processing advances to step S508. However, in any other case, the processing advances to step S510. At this time, since the rider gets off the simulated bicycle 12 and stands alongside the simulated bicycle 12, one of the left switch 150L and the right switch 150R of the mat switch 16 is treaded at predetermined time intervals. Accordingly, if it is imagined that the rider gets off the simulated bicycle 12, for example, to the left side of the simulated bicycle 12, then the walking state may be detected based only on the left switch 150L of the time chart of FIG. 22, and it may be decided that the rider is in the walking state within the periods T5 and T6.

At step S508, an image that a rider having got off the bicycle retreats by pushing the bicycle is displayed on the screen 14*a* under the control of the display control section 184 as seen in FIGS. 24 and 25. At this time, the retreating direction of the bicycle on the screen 14*a* may be changed based on the steering angle $\theta_H$ detected by the steering angle sensor 50.

At step S509, it is confirmed whether or not the retreating mode is canceled. If the retreating mode is not canceled, then the processing returns to step S501 to continue the process of the retreating mode, but if the retreating mode is canceled, then the processing of the retreating mode is ended. In the case of the example shown in FIG. 24, the retreating mode is canceled when the bicycle retreats fully from the pedestrian crossing 300 to the sidewalk 302.

In this manner, in the retreating mode, since the screen 14*a* displays a corresponding image based on the operation of the rider in operating the grip detection section 56 of the simulated bicycle 12 and treading the mat switch 16 at predetermined time intervals, the rider can feel as if the rider actually moved the bicycle rearwardly. Further, after the bicycle retreats fully, the retreating mode is canceled and the rider is permitted to advance in any direction. Accordingly, even if the bicycle during the simulated operation excessively approaches an obstacle, such an unnatural process so as to end the simulated operation or to erase the simulated obstacle need not be performed, which is realistic.

Figure 27:
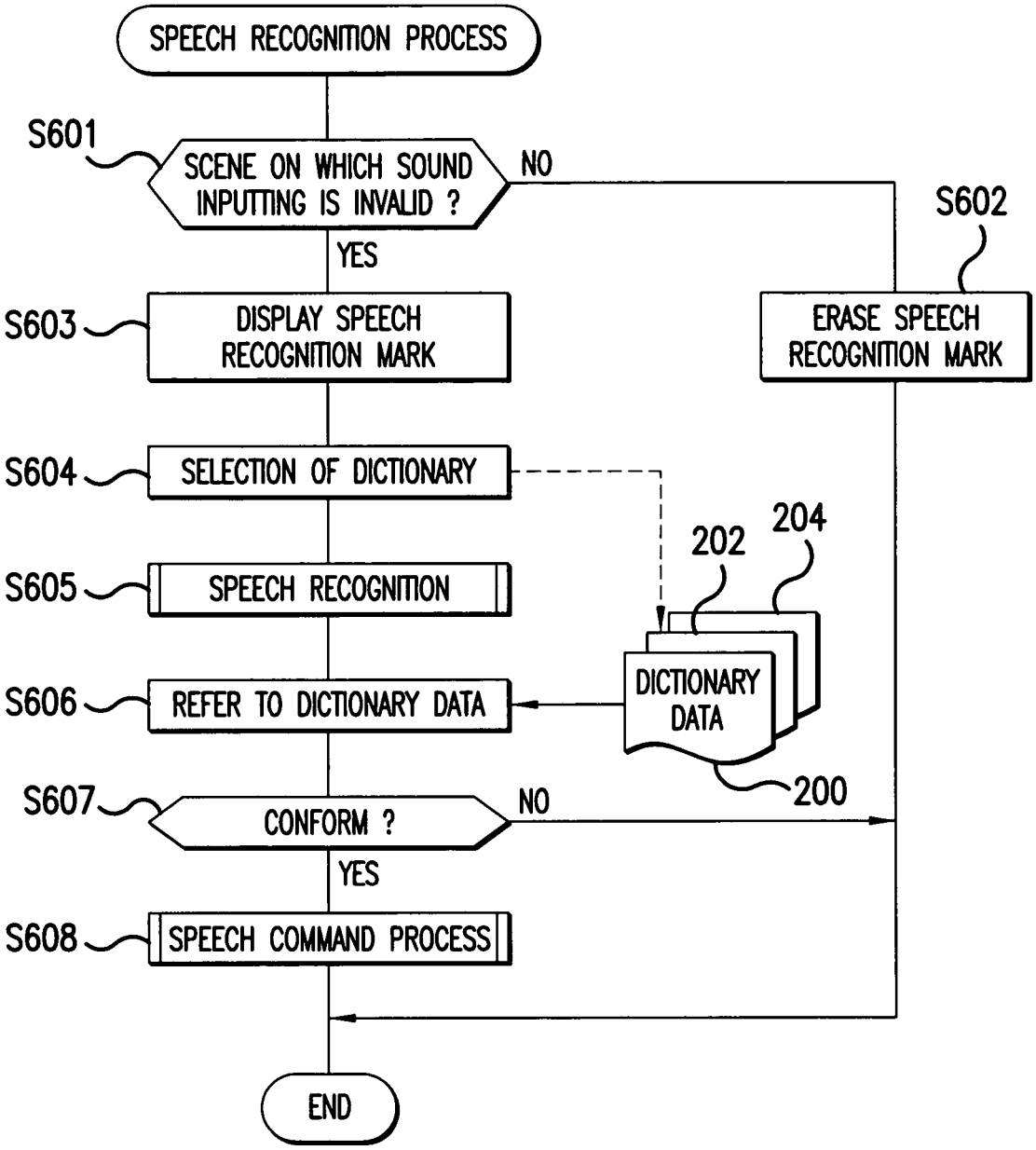
FIG. 27 is a flow chart illustrating contents of a speech recognition process.
Figure 28:
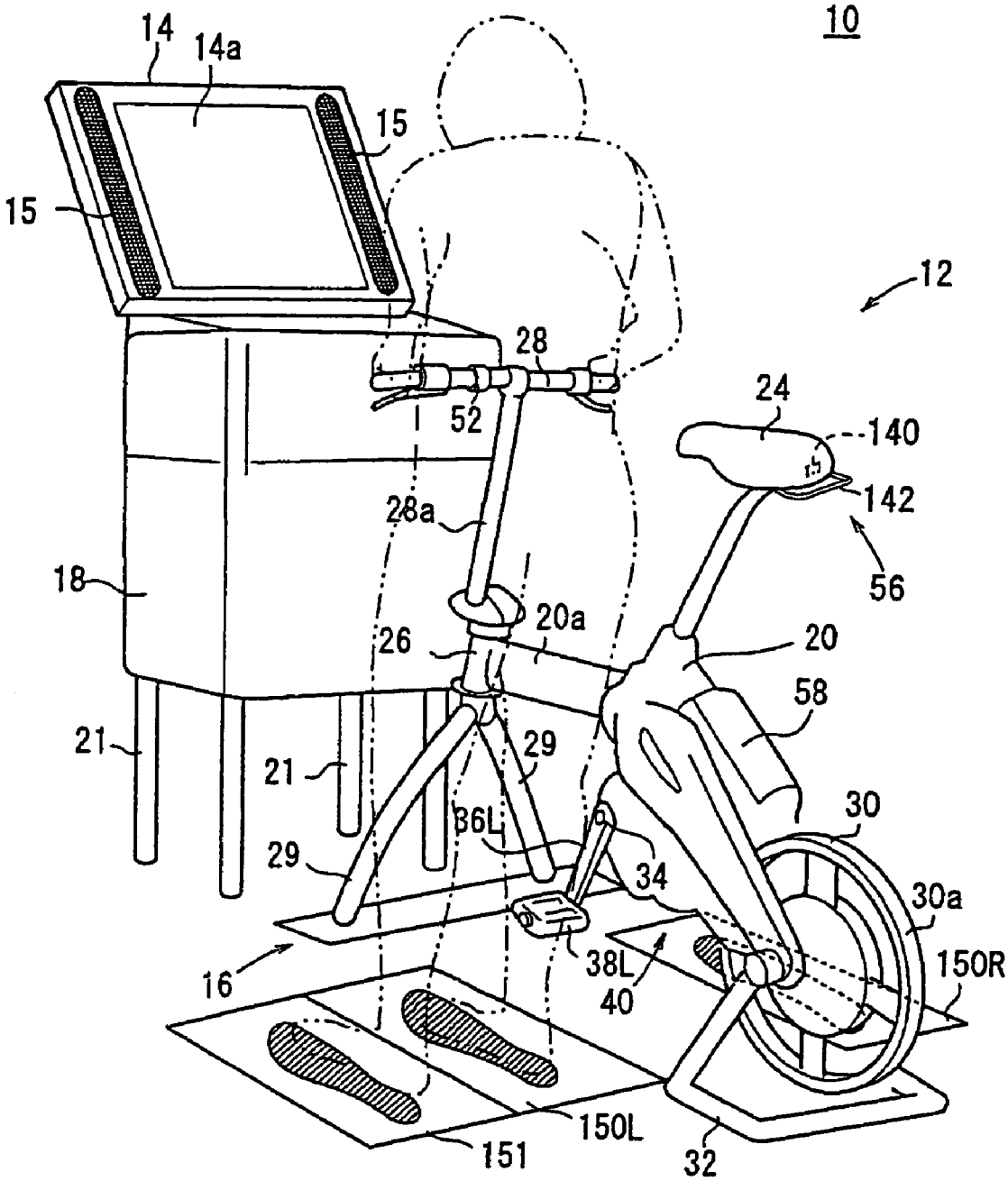
FIG. 28 is a perspective view of a simulation apparatus which includes an additional switch.
Figure 29:
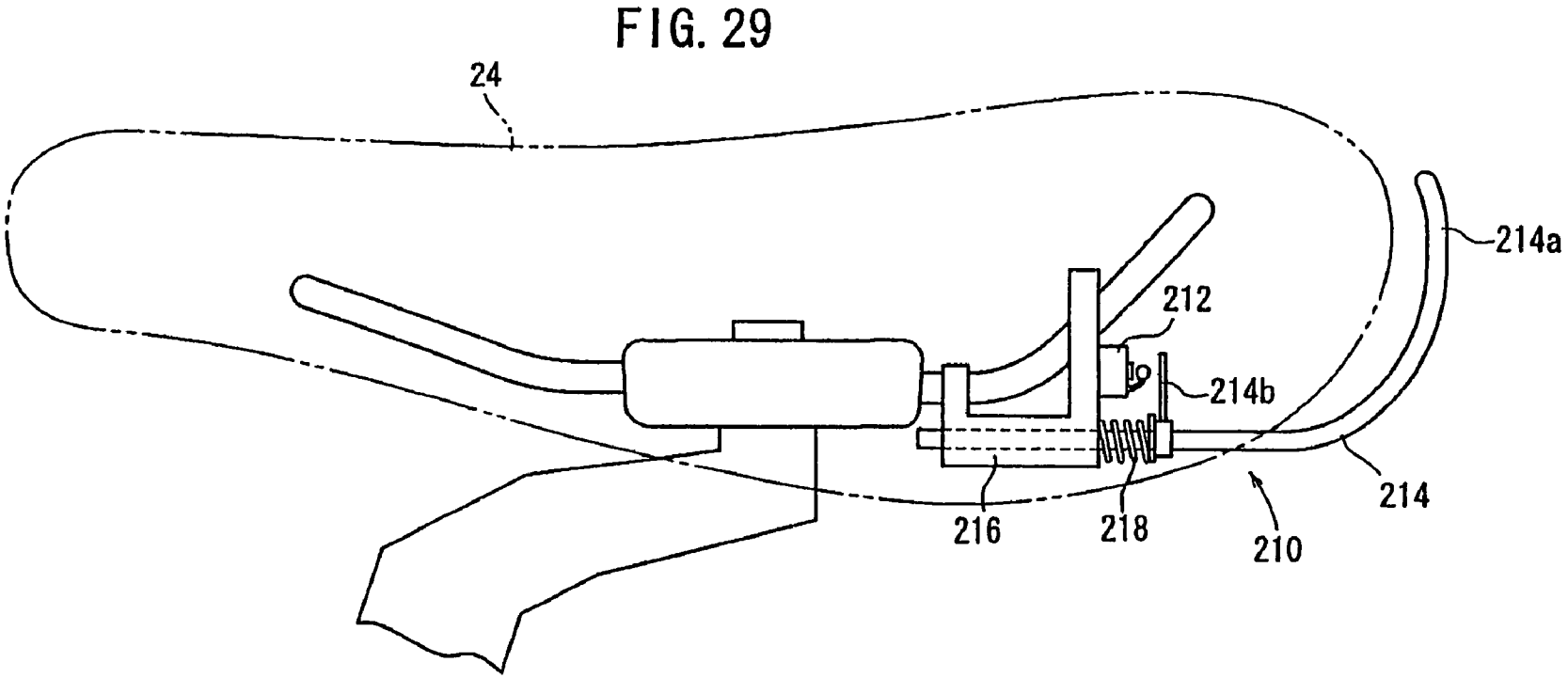
FIG. 29 is a schematic side elevational view of a modification to a grip detection section.

Now, the contents of the speech recognition process executed at steps S102, S302, S402 and S502 are described with reference to FIG. 27.

First at step S601, it is confirmed whether or not the situation on the simulated operation is a situation in which sound inputting is valid. If the situation is such that sound inputting is invalid, the processing advances to step S602, but if the situation is such that sound inputting is valid, the processing advances to step S603.

The situation in which sound inputting is valid is, for example, a traveling mode other than the foot landing mode, walking mode, retreating mode and the cornering mode and is a situation wherein the processing load applied to the CPU described hereinabove is comparatively low. On the other hand, the situation in which sound inputting is invalid is, for example, a cornering mode in the traveling mode or the like and is a situation wherein the processing load applied to the CPU is comparatively heavy since the CPU executes such processes as an arithmetic operation of the bank angle $\theta_B$ and a determination of the angles of rotation of the cranks 36L and 36R based on the signals of the left proximity sensor 132L and the right proximity sensor 132R.

Further, the processing load applied to the main control section 18 may be monitored based on a predetermined monitor system or resource meter such that, when the processing load is equal to or higher than a predetermined value, sound inputting is determined invalid.

At step S602, the speech recognition mark 19 on the screen 14*a* is erased or displayed less indistinctly to indicate that the speech recognition is invalid. After the process at step S602, the processing in the present cycle in the speech recognition process illustrated in FIG. 27 is ended.

On the other hand, at step S603, the speech recognition mark 19 is displayed on the screen 14*a* so as to indicate that the speech recognition is valid. If the rider observes the speech recognition mark 19, then the rider can readily recognize that the processing by the speech recognition is valid at the current point in time.

Whether sound inputting is valid or invalid may be indicated, for example, by an on/off of lighting of a predetermined lamp. In this instance, the lamp should be provided in the proximity of the monitor 14 or the microphone 52.

At step S604 (dictionary selection section), one of the dictionary data recorded in the storage section 194 is selected. In particular, in any mode other than the traveling mode, the stopping and walking dictionary data 200 is selected, but when the bicycle is in the traveling mode and traveling in a city, the in-city traveling dictionary data 202 is selected. However, when the bicycle is in the traveling mode and traveling in the suburbs, the suburb traveling dictionary data 204 is selected.

Further, if it is determined based on the flag set at step S3 described hereinabove that the rider is a child, then the child dictionary data 200*a*, 202*a* or 204*a* and the common dictionary data 200*c*, 202*c* or 204*c* are selected, but if it is determined that the rider is an adult, then the adult dictionary data 200*b*, 202*b* or 204*b* and the common dictionary data 200*c*, 202*c* or 204*c* are selected.

For example, if the rider is a child and travels in a city, the child dictionary data 202*a* and the common dictionary data 202*c* of the in-city traveling dictionary data 202 are selected.

It is to be noted that the selection of dictionary data is performed upon transition of a mode (for example, in the branching process at step S4, S6, S8 or S10 of FIG. 13), and predetermined dictionary data may be loaded from the storage section 194 into the RAM or the like in advance. This makes high-speed accessing to data possible.

At step S605, the speech of the rider inputted from the microphone 52 is analyzed to recognize that the rider has uttered, for example, "right" or "left."

At step S606, the speech of the rider inputted from the microphone 52 at step S605 and dictionary data selected at step S604 are referred to for searching for specify phrase data conforming to the recognized speech.

At step S607, it is recognized by the search process at step S606 described hereinabove whether or not the phrase data exists in the dictionary data. If conforming phrase data exists, then the processing advances to step S608, but if conforming phrase data does not exist, then the processing in the present cycle is ended.

At step S608, a speech command process is performed based on the phrase data conforming to the recognized speech. For example, where the in-city traveling dictionary data 202 is selected and the recognized speech is "left," the common dictionary data 202*c* (refer to FIG. 12) is referred to, and then the main control section 18 or the sub-control section 58 cooperates with the display control section 184 to cause the screen 14*a* to display an image estimated to be an image leftwardly of the rider. Further, where the in-city traveling dictionary data 202 is selected and the rider is a child and the speech recognized is "make heavier," the child dictionary data 202*a* is referred to first, and then the motor 96 is rotated through the sub-control section 58 to tilt the load plate 90 so as to approach the rim 30*a* and increase the velocity coefficient described hereinabove for calculating the traveling speed V. Furthermore, the value of the transmission gear ratio estimated at the point of time is displayed on the screen 14*a*. After this process at step S608, the processing in the current cycle of the speech recognition illustrated in FIG. 27 is ended.

In such a speech recognition process as described above, by selecting individual dictionary data in accordance with a mode of traveling and the rider to analyze the speech, the capacity of each individual dictionary data may be small. The processing load when the main control section 18 refers to and searches the dictionary data is light, and high speed processing is possible. Further, the CPU, RAM and so forth of the main control section 18 may be formed from inexpensive devices or devices of a small capacity Furthermore, since the dictionary data are provided individually corresponding to the modes of traveling and the riders, it is avoided that both of analogous phrase data are present as phrase data to be recorded, and wrong recognition of speech is prevented and the accuracy in recognition is enhanced.

Since the child dictionary data 200*a*, 202*a* and 204*a* and the adult dictionary data 200*b*, 202*b* and 204*b* are provided, a speech command can be executed without an unfamiliar feeling using terms which are generally used by children (for example, a term "make heavier") or terms used by adults (for example, a term "shift-up"), and riders in various age groups can use the bicycle simulation apparatus. Since the child dictionary data 200*a*, 202*a* and 204*a* and the adult dictionary data 200*b*, 202*b* and 204*b* are provided separately, such bad effects such as the occurrence of a wrong recognition of speech, a drop of the processing speed and so forth arising from the fact that the system is designed commonly for both children and adults does not occur. Since a bicycle is a vehicle which is ridden not only by a child but also by an adult, such a speech recognition apparatus as described above is particularly effective for the bicycle simulation apparatus 10 for a bicycle from among various bicycle simulation apparatus. Further, where the dictionary data are divided for different languages such as Japanese and English, a bicycle simulation apparatus 10 is effective which is used in various shipment destinations including export destinations.

Further, since the speech recognition process can be stopped under a predetermined situation, the processing load applied to the CPU can be suppressed and the averaging of the load can be anticipated. Accordingly, the capacity of the CPU in a low load condition does not become excessive and the enhancement of the utilization of the CPU can be achieved. In addition, since the speech recognition mark 19 is displayed or not displayed on the screen 14*a* in response to an operation condition of the speech recognition process, the rider can confirm the operation condition of the speech recognition process at a glance and can issue an instruction at a suitable timing. Consequently, the rider need not pay excessive attention to the timing at which a voice instruction is to be issued. As a result, the operability of the bicycle simulation apparatus 10 is enhanced.

It is to be noted that an additional switch 151 similar to the left switch 150L may be provided on the further left side of the left switch 150L such that a simulated walking may be performed by alternately treading the left switch 150L and the additional switch 151 in the walking mode and the retreating mode. This makes it possible for the rider to perform a walking movement and a retreating movement in a posture that is the same as that in the actual pushing and walking mode, which further increases the feeling of presence. In this instance, the rider treads the additional switch 151 with the left foot and treads the left switch 150L with the right foot. Where the bicycle simulation apparatus 10 is used in a country in which such pushing and walking is habitually performed on the right side of a two-wheeled vehicle, the additional switch 151 may be provided on the right side of the right switch 150R.

While it is described that the grip detection section 56 is provided at a rear lower portion of the saddle 24, it is only necessary for an operation section corresponding to the grip detection section 56 to be provided at a position at which the rider can easily operate the same when it performs a retreating movement. Thus, the operation section may be provided rearwardly of the saddle 24 like a grip detection section 210 shown in FIG. 29.

The grip detection section 210 is a modification to the grip detection section 56, and includes a retreating switch 212 in the form of a momentary type limit switch provided rearwardly of the saddle 24, a lever 214 for operating the retreating switch 212 on and off, and a bracket 216 serving as a support. By operating a rear operation portion 214*a* of the lever 214, the lever 214 can be slidably moved resiliently in the forward direction with respect to the bracket 216 while being acted upon by resilient force of a spring 218. When the lever 214 is slidably moved forwardly, a contactor 214*b* thereon is contacted with the retreating switch 212 to place the retreating switch into an on state. The operation portion 214*a* extends upwardly from a rear lower portion of the lever 214 to a height substantially equal to that of the rear upper portion of the saddle 24. When the rider gets off the simulated bicycle 12, the rider can touch with the upper face of the saddle 24 and the rear face of the operation portion 214*a* at a time and operate the lever 214 readily so as to be drawn near. The grip detection section 210 exhibits an effect similar to that of the grip detection section 56.

A vehicle for providing a simulated riding on the bicycle bicycle simulation apparatus 10 may be any vehicle such as a tricycle, a motor assisted cycle or the like. The vehicle may have at least the fundamental structure part of a bicycle such as a handlebar, crank or the like.

The bicycle simulation apparatus according to the present invention is not limited to the embodiment described hereinabove but can naturally adopt various configurations without departing from the spirit of the present invention.

The invention being thus described, it will be obvious that the same may be varied in many ways. Such variations are not to be regarded as a departure from the spirit and scope of the invention. All such modifications as would be obvious to one skilled in the art are intended to be included within the scope of the following claims.

What is claimed is:

1. A bicycle simulation apparatus comprising:

a simulated bicycle comprising a saddle adapted for positioning a rider on the simulated bicycle and a steering section operable by the rider;

a momentary retreating switch provided on said simulated bicycle and manually operable by the rider after dismounting from said simulated bicycle; wherein said retreating switch is provided at a rear portion or a rear lower portion of the saddle, wherein said retreating switch is adapted to be operated when a lever disposed below the retreating switch is manually moved to make contact with the retreating switch, and when the lever is moved upward with respect to the saddle and makes contact with the retreating switch, the retreating switch is switched on and a display section for displaying a scene based on the operation of said steering section and a signal of said retreating switch;

wherein when said retreating switch is operated, an image of a bicycle and a rider operating the bicycle to retreat is displayed on said display section.

2. The bicycle simulation apparatus according to claim 1, and further including at least one mat switch for providing a signal that the rider has dismounted from the bicycle and the bicycle is not being operated.

3. The bicycle simulation apparatus according to claim 2, wherein the mat switch includes a plurality of longitudinal electrode lines adhered to a rear face of a sheet and transverse electrode lines adhered to a front face of a sheet with an insulating material being disposed therebetween.

4. The bicycle simulation apparatus according to claim 1, and further including a sensor operatively mounted to a steering mechanism for the bicycle for providing a signal responsive to a turning of the steering mechanism to the left or to the right for determining a cornering of the bicycle.

5. The bicycle simulation apparatus according to claim 4, wherein a warning signal is generated when a bank angle of the bicycle is greater than a predetermined angle for simulating a situation wherein a left or right crank engages a ground surface occurs.

6. The bicycle simulation apparatus according to claim 1, wherein said bicycle simulation apparatus further includes a rider detection section for detecting that the rider's foot is positioned on the floor; and an image is displayed on said display section as an additional condition that said rider detection section detects at a predetermined interval that the foot of the rider is landed on the floor.

7. The bicycle simulation apparatus according to claim 1, wherein the lever is rotatably mounted to a saddle support and is biased away from said retreating switch.

8. The bicycle simulation apparatus according to claim 1, and further including a pair of cranks each having a pedal at an end thereof and connected to the left and right of a crankshaft, a left proximity sensor operatively connected to a left crank and a right proximity sensor operatively connected to a right crank for determining the orientation of the left and right cranks and for generating an output that is displayed on the display section.

9. The bicycle simulation apparatus according to claim 1, and further including a lever mounted relative to said saddle and hinged on a saddle support of the bicycle, said lever having a rear portion that extends laterally across a rear portion of the saddle for selectively actuating said momentary retreating switch when the rear portion of the lever is elevated with respect to the saddle.

10. A bicycle simulation apparatus comprising:

a frame for a simulated bicycle;

a saddle adapted for positioning a rider on the simulated bicycle, said saddle being operatively mounted relative to the frame;

a steering mechanism operable by the rider, said steering mechanism being operatively mounted relative to the frame;

a momentary retreating switch provided on said simulated bicycle and manually operable by the rider after dismounting from said simulated bicycle, wherein said retreating switch is provided at a rear portion or a rear lower portion of saddle, said retreating switch being operated when a lever disposed below said retreating switch is manually moved upwardly to make contact with said retreating switch when the lever is moved upward with respect to the saddle and makes contact with the retreating switch, said retreating switch is switched on; and a display section for displaying a scene based on the operation of said steering section and a signal of said retreating switch;

wherein when said retreating switch is operated, an image of a bicycle and a rider operating the bicycle to retreat is displayed on said display section.

11. The bicycle simulation apparatus according to claim 10, and further including at least one mat switch for providing a signal that the rider has dismounted from the bicycle and the bicycle is not being operated.

12. The bicycle simulation apparatus according to claim 11, wherein the mat switch includes a plurality of longitudinal electrode lines adhered to a rear face of a sheet and transverse electrode lines adhered to a front face of a sheet with an insulating material being disposed therebetween.

13. The bicycle simulation apparatus according to claim 10, and further including a sensor operatively mounted to the steering mechanism for the bicycle for providing a signal responsive to a turning of the steering mechanism to the left or to the right for determining a cornering of the bicycle.

14. The bicycle simulation apparatus according to claim 13, wherein a warning signal is generated when a bank angle of the bicycle is greater than a predetermined angle for simulating a situation wherein a left or right crank engages a ground surface occurs.

15. The bicycle simulation apparatus according to claim 10, wherein said bicycle simulation apparatus further includes a rider detection section for detecting that the rider's foot is positioned on the floor; and an image is displayed on said display section as an additional condition that said rider detection section detects at a predetermined interval that the foot of the rider is landed on the floor.

16. The bicycle simulation apparatus according to claim 10, and since said lever is provided at the rear portion or the rear lower portion of said saddle, the lever does not provide an obstacle when the rider is seated on the saddle.

17. The bicycle simulation apparatus according to claim 10, and further including a pair of cranks each having a pedal at an end thereof and connected to the left and right of a crankshaft, a left proximity sensor operatively connected to a left crank and a right proximity sensor operatively connected to a right crank for determining the orientation of the left and right cranks and for generating an output that is displayed on the display section.

18. The bicycle simulation apparatus according to claim 10, and further including a lever mounted relative to said saddle and hinged on a saddle support of the bicycle, said lever having a rear portion that extends laterally across a rear portion of the saddle for selectively actuating said momentary retreating switch when the rear portion of the lever is elevated with respect to the saddle.

* * * * *